US005553593A

United States Patent [19]

Schnaibel et al.

[11] Patent Number: 5,553,593

[45] Date of Patent: Sep. 10, 1996

[54] CONTROL SYSTEM AND METHOD FOR METERING THE FUEL IN AN INTERNAL COMBUSTION ENGINE

[75] Inventors: Eberhard Schnaibel, Hemmingen; Rolf-Hermann Mergenthaler, Leonberg; Lutz Reuschenbach, Stuttgart; Hans Veil, Eberdingen; Eduard Weiss, Metternzimmern, all of Germany

[73] Assignee: Robert Bosch GmbH, Stuttgart, Germany

[21] Appl. No.: 488,355

[22] Filed: Jun. 7, 1995

[30] Foreign Application Priority Data

Jun. 16, 1994 [DE] Germany ..... 44 20 946.0

[51] Int. Cl.[6] ..... F02D 41/00

[52] U.S. Cl. ..... 123/682

[58] Field of Search ..... 123/682, 492, 123/493, 436, 681, 478, 480, 489; 364/431.05, 426, 431

[56] References Cited

U.S. PATENT DOCUMENTS

| | | | |
|---|---|---|---|
| 4,319,327 | 3/1982 | Higashiyama et al. . | |
| 5,239,974 | 8/1993 | Ebinger et al. | 123/675 |
| 5,243,948 | 9/1993 | Schnaibel et al. | 123/492 |
| 5,347,974 | 9/1994 | Togai et al. | 123/682 |
| 5,381,776 | 6/1995 | Matsubara et al. | 123/681 |
| 5,413,078 | 5/1995 | Mitsunanga et al. | 123/492 |
| 5,433,185 | 7/1995 | Toyoda | 123/682 |
| 5,447,137 | 9/1995 | Asano et al. | 123/436 |
| 5,469,832 | 11/1995 | Nemoto | 123/682 |

FOREIGN PATENT DOCUMENTS

| | | |
|---|---|---|
| 0360193 | 3/1990 | European Pat. Off. . |
| 4243449A1 | 6/1994 | Germany . |
| 4323244A1 | 1/1995 | Germany . |
| 2255658 | 11/1992 | United Kingdom . |

*Primary Examiner*—Raymond A. Nelli
*Attorney, Agent, or Firm*—Kenyon & Kenyon

[57] ABSTRACT

A control system is described for metering the fuel in an internal combustion engine. On the basis of the operating state of the internal combustion engine and a mixture correction signal for correcting the deviation of the air/fuel ratio from a desired value, a basic injection quantity signal is generated. A transition compensation signal is also generated while taking into account an adaptive correction factor. The adaptive correction factor is generated by comparing the mixture correction signal with a reference. The transition compensation signal is logically combined with the basic injection quantity signal to form a signal indicative of the quantity of fuel to be injected. In a second exemplary embodiment, the adaptive correction factor is determined by comparing the output signal of an exhaust gas sensor with a reference. In a third exemplary embodiment, both the mixture correction signal and the output signal of the exhaust gas sensor are included in the determination of the transition compensation signal.

12 Claims, 23 Drawing Sheets

Fig. 6a
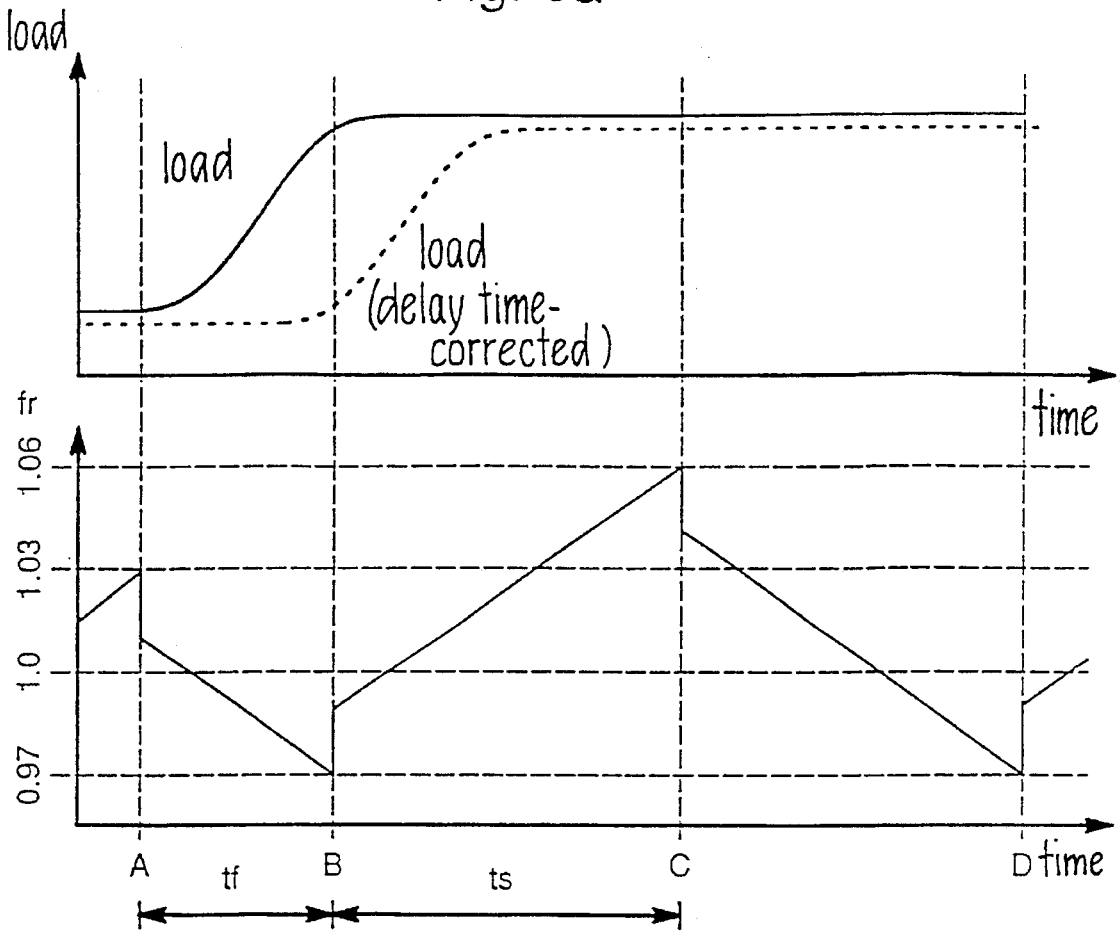
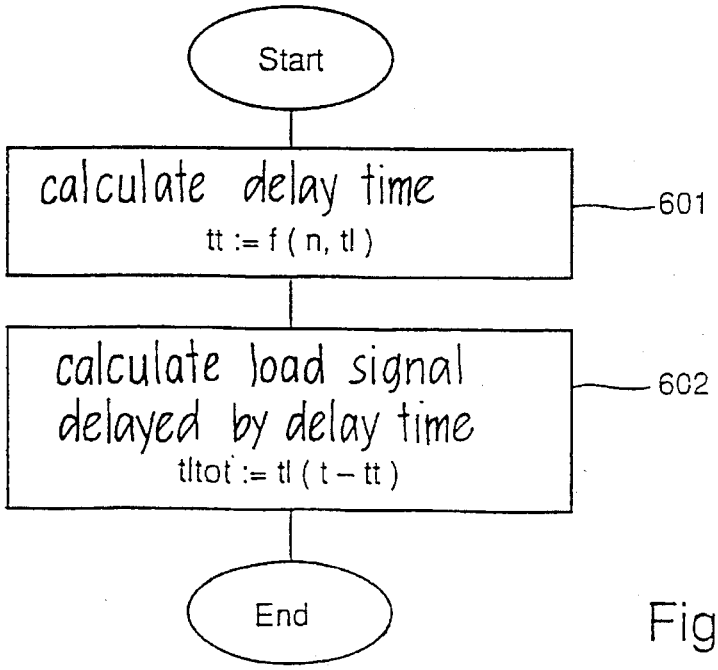
Fig.6b

CONTROL SYSTEM AND METHOD FOR METERING THE FUEL IN AN INTERNAL COMBUSTION ENGINE

FIELD OF THE INVENTION

The present invention relates to a control system for metering the fuel in an internal combustion engine, particularly to a system which compensates for fuel wall film deposit.

BACKGROUND INFORMATION

In order to keep the air/fuel ratio of an internal combustion engine constant, in particular during non-steady-state operation, the quantity of fuel to be injected which corresponds to the air charge of a cylinder must be corrected by a value which takes into account the build up or reduction of the fuel wall film deposited in the inlet pipe and on the inlet valves. German Published Patent Application No. 39 39 548 A describes such a wall film compensation scheme.

The selection of the parameters of such a method is, however, dependent on the state of aging of the engine and on the type of fuel used. The wall film behavior during non-steady-state operation can change significantly as a result of inlet valve carbonization or as a result of filling the fuel tank with a different fuel from that used to calibrate the method. As a result, exhaust gas emissions and driving behavior are worsened.

German Published Patent Applications Nos. 42 43 449 A and 43 23 244 A describe adaptation methods which, on the basis of the variation in the air/fuel ratio during non-steady-state operation, adapt the wall film compensation parameters during operation to the respective fuel and to the carbonization state of the engine. However, these methods require the use of a linear lambda sensor which is significantly more expensive than the Nernst probes which are customary at the present time.

In German Published Patent Application No. 41 15 211 A, a different method is illustrated which avoids the aforementioned disadvantage. However, in accordance with that reference, there is a requirement for the lambda control to be switched off during a non-steady-state process, which can lead to worsening of the exhaust gas emissions.

SUMMARY OF THE INVENTION

The present invention provides a control system for metering fuel in an internal-combustion engine which permits wall film compensation parameters to be adapted with the lambda control operating and with the use of economical Nernst probes. Thus, the disadvantages of known systems are avoided.

In modern engine controls, a so-called two-point lambda control is used in which the air/fuel ratio and the adjustment variable of the controller oscillate periodically about their desired value. In the adaptation method of the present invention, the amplitude of such control oscillations is monitored. If a clear deviation of the amplitude from the normal value is detected, a severe disruption of the air/fuel ratio is evidently present. If at the same time there is a change in load or in the rotational speed of the motor, it is concluded that there has been a change in the wall film behavior and one or more of the wall film compensation parameters are adapted.

BRIEF DESCRIPTION OF THE DRAWINGS

FIG. 6*a* shows the variation over time of the control factor fr if a mixture fault is produced because of a load change and a changed wall film behavior, which the lambda controller attempts to compensate.

FIG. 6*b* is a flow-chart illustrating a procedure for performing a delay time correction of the load signal so that the variation in load can be assigned with correct timing to the variation in the control factor fr.

DETAILED DESCRIPTION OF THE DRAWINGS

Figure 1:
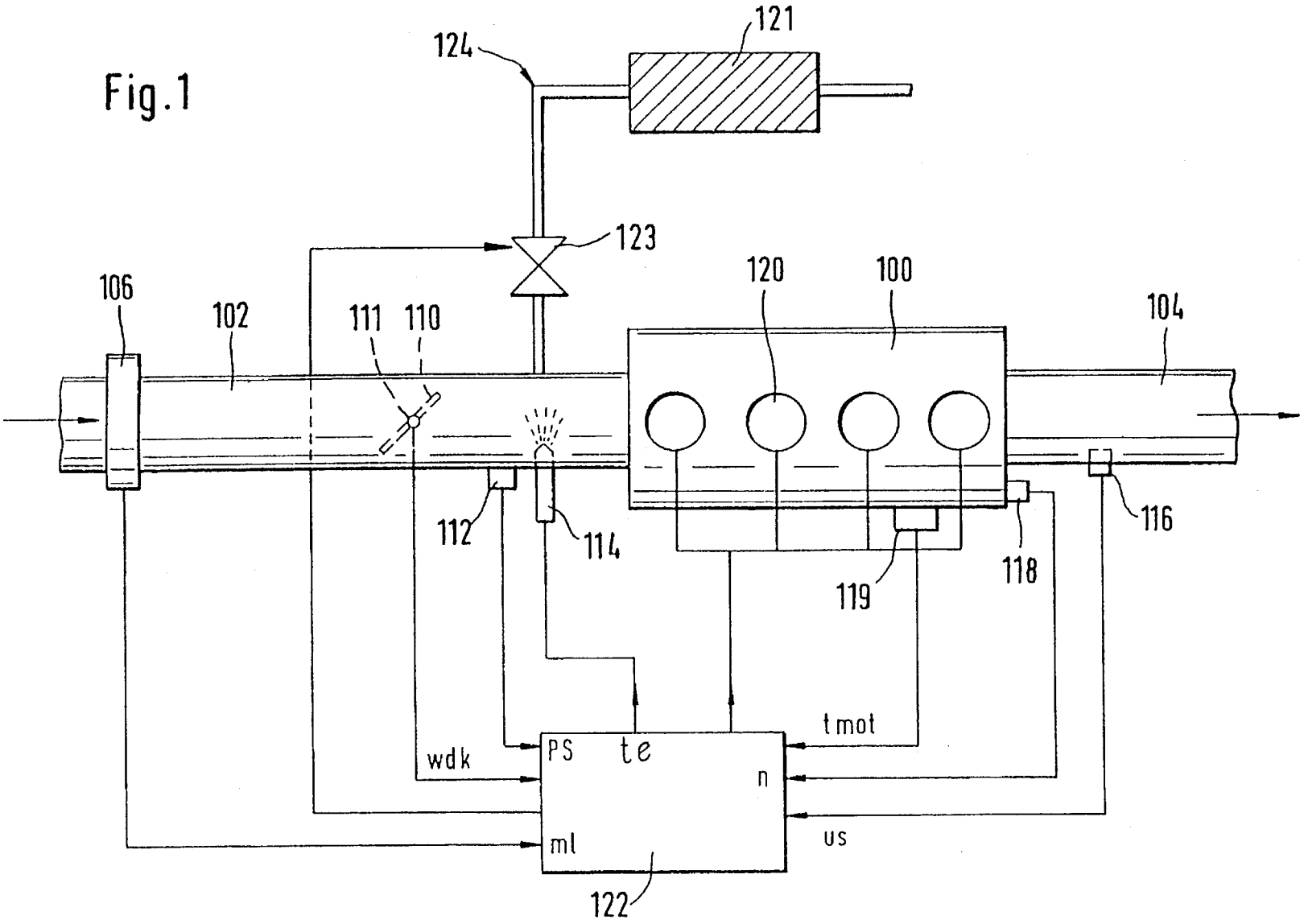
FIG. 1 shows an overview of an internal combustion engine with a device for controlling fuel injection time in accordance with the present invention.

FIG. 1 shows an internal combustion engine 100 and a control device 122 for controlling fuel injection timing.

The air flow ml flowing into an inlet pipe 102 is detected by an air flow sensor 106 (hot wire or hot film sensor) and fed to the control device 122. The position wdk of a throttle valve 110 is measured with a sensor 111. Instead of the air flow sensor 106, a sensor 112 for detecting the inlet pipe pressure ps can also be used.

The air/fuel mixture is drawn in by the engine 100 while combustion gases pass into an exhaust gas system 104. In the exhaust gas system 104, the residual oxygen concentration is measured by means of a lambda probe 116. The output voltage us of the probe 116 is provided to the control device 122. In addition, there is a temperature sensor 119 on the engine block 100 for detecting the engine temperature tmot (usually the temperature of the cooling water), and a sensor 118 for detecting the crankshaft position and the rpm n.

The quantity of fuel (injection time te) calculated by the control device (122) is fed to the engine via an injection valve 114. Instead of the centrally arranged injection valve 114, an individual injection valve can be mounted in the inlet duct of each cylinder. In addition, the control device 122 determines the ignition time and actuates the ignition coil for the spark plugs 120.

An activated carbon filter 121 of the fuel tank vent is flushed with fresh air while the engine is operating and the air/fuel mixture flushed out of the filter is directed via a line 124 into the inlet pipe 102 and then combusted in the engine. As a result, the composition of the mixture fed to the engine is disrupted. In order to be able to meter this disruption and compensate it as far as possible, the flushing of the carbon filter with a spot valve 123 can be controlled from the engine control 122.

Figure 2A:
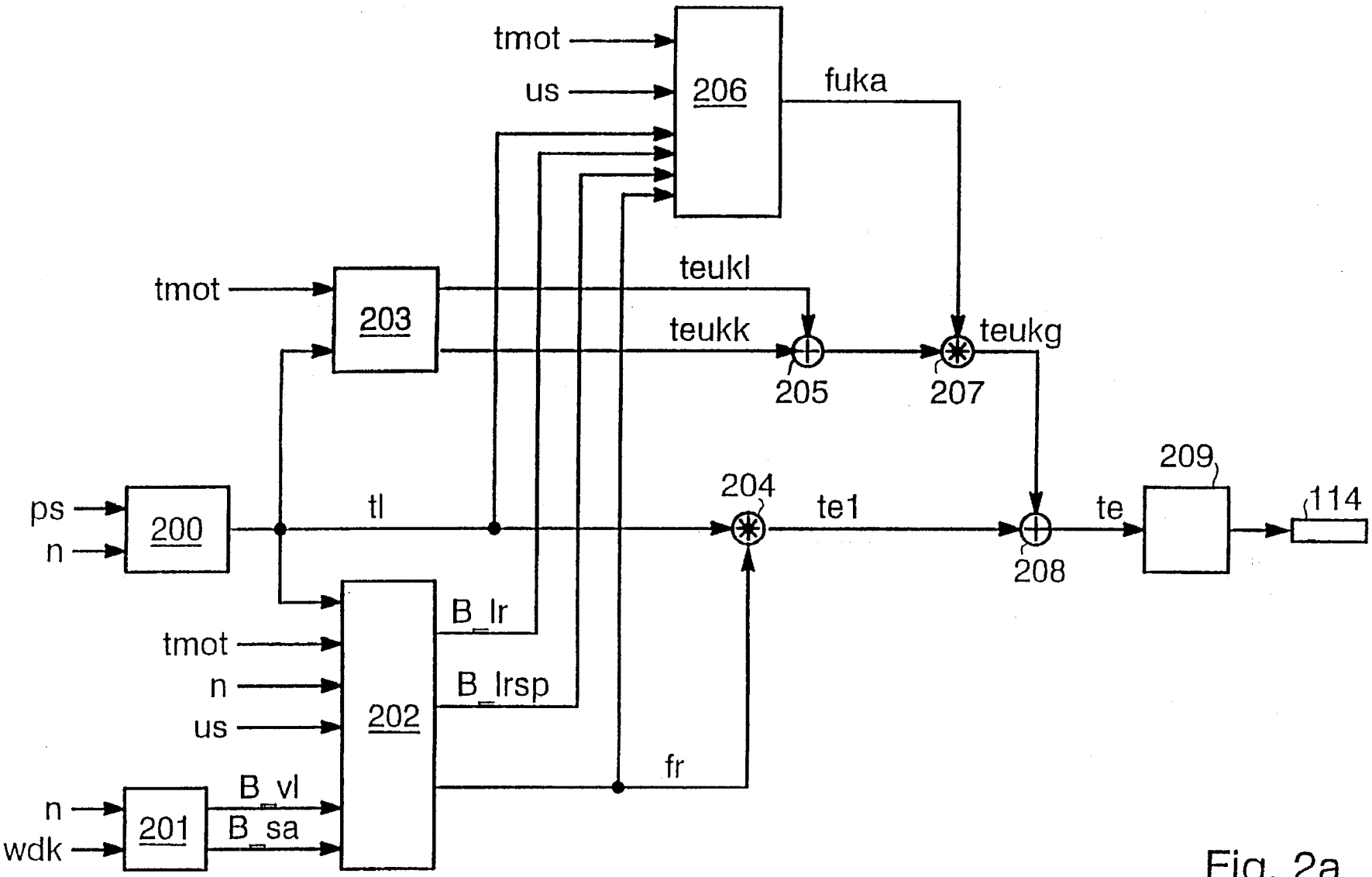
FIG. 2*a* is a block diagram illustrating the determination of the fuel injection time, in accordance with the present invention, in which one wall film compensation parameter is corrected.

FIG. 2*a* illustrates the calculation of the injection time by the controller 122.

In block 200, the instantaneous air charge (load) tl of a cylinder is initially calculated, for example, from the inlet pipe pressure ps and rpm n. Methods for performing such a calculation are known and thus will not be described in greater detail. The numerical value of the load signal tl corresponds to the injection time which is required to set a stoichiometric air/fuel ratio.

In block 201, the operating states "full load" (B_vl) and "thrust deactivation" (B_sa), which are important, inter alia, for lambda control, are determined from the throttle valve angle wdk and the rpm n. A simple method for carrying out the function of block 201 is shown in greater detail in FIG. 3.

Block 202 represents the lambda control. By determining a correction factor fr which is subsequently multiplied by the load tl at a multiplication point 204, the object of the lambda control is to compensate errors in the load calculation (e.g. as a result of an erroneous inlet pipe pressure signal) or in the fuel metering (for example resulting from manufacturing tolerances of the injection valve 114) and thus to ensure a constant air/fuel ratio during steady-state operation. The probe voltage us from the lambda probe 116 is used for this purpose.

The lambda control is switched off during warming up by means of the engine temperature tmot. The rpm n and load tl are required to select the control parameters of the lambda control as a function of the operating point. Full load and thrust deactivation lead to deactivation of the lambda control. A method for calculating the control factor fr is described in detail in FIGS. 5*b* through 5*e*.

The load tl is weighted with the control factor fr at the multiplication point 204. As a result, possible steady-state errors in the load detection or in the injection are corrected.

In block 203, the build up of wall film is estimated from the load tl and the engine temperature tmot. In the exemplary embodiment of FIG. 2*a*, correction signals teukl and teukk are calculated by the block 203. The signal teukk acts directly during and just after a change in load while the signal teukl influences the injection time over a significantly longer time period after a change in load. However, variants with only one correction variable or with a plurality of correction variables, each of which is active in a specific time range during or after a change in load, are also conceivable. A detailed description of the wall film compensation is contained in the flow-charts of FIGS. 4*a* and 4*b*.

In the adaptation of block 206, it is tested with reference to a variation of the control factor fr or of the probe voltage us or of the load signal tl whether a change of the wall film behavior with respect to the new state is present, and an appropriate correction signal fuka is determined. The correction factor fuka can also depend on the engine temperature tmot since when using different kinds of fuels a significantly different correction of the wall film compensation may be required due to the different variation in the boiling point curves for a cold engine as opposed to a warm engine. A plurality of variants for an adaptation are described in detail in FIGS. 6*a* through 8*f*.

The output variables teukk and teukl of the wall film compensation block 203 are added at a logic connection point 205 and weighted at a point 207 with the correction factor fuka calculated from the adaptation in block 206. The resulting correction signal teukg is added at a summing point 208 to the steady state injection time tel to yield an overall injection time te. The output stage of the injection valve 114 is actuated in block 209 with the overall injection time te.

Methods are known in which instead of an additive correction— as is performed at summing point 208—a multiplicative correction of the injection time is carried out during non-steady-state operation. The adaptation methods described here for the wall film compensation can also be applied for such a case.

Figure 2B:
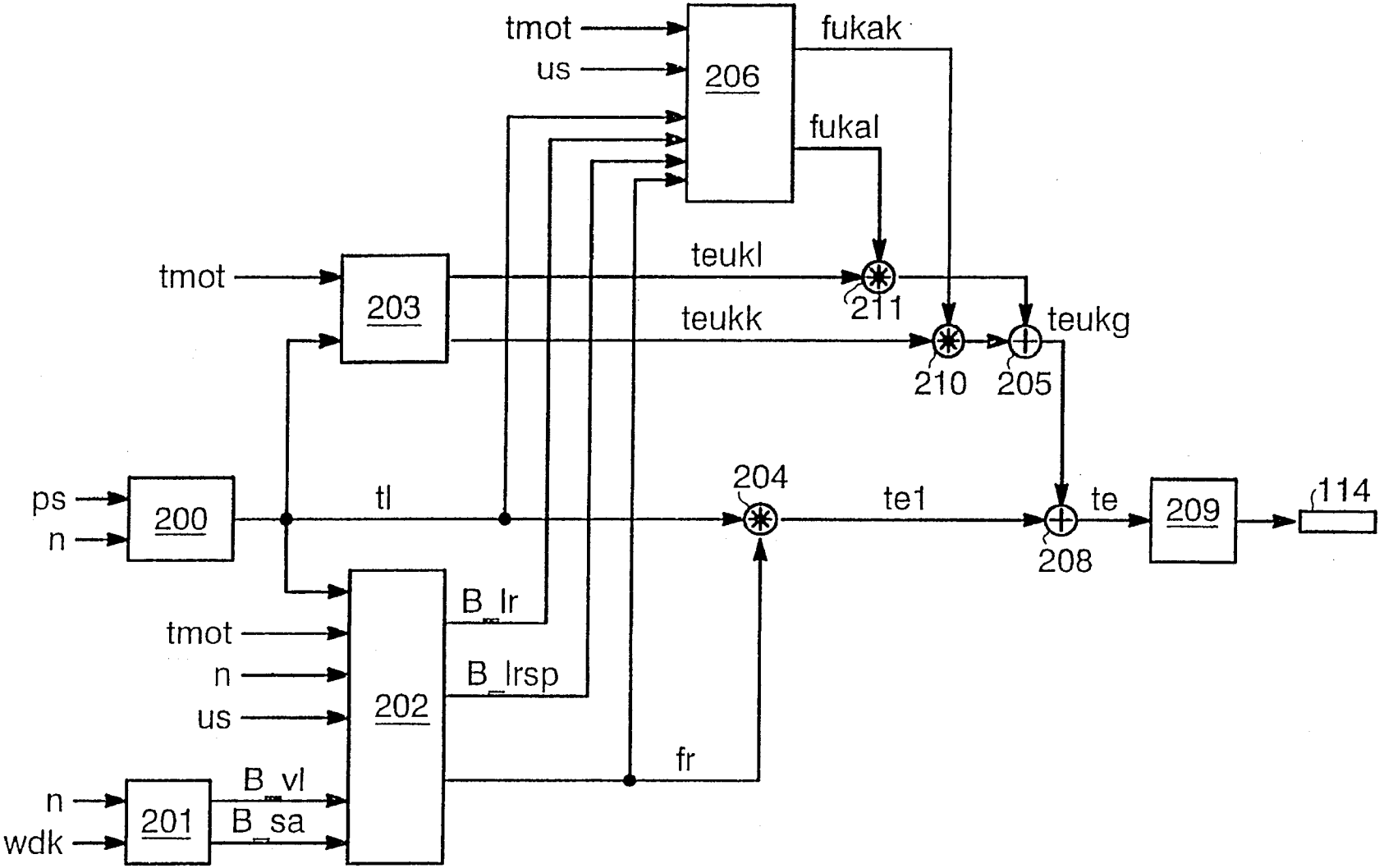
FIG. 2*b* is a block diagram illustrating the determination of the fuel injection time, in accordance with the present invention, in which a plurality of wall film compensation parameters are corrected.

FIG. 2*b* illustrates a variant of the calculation of the injection time described in FIG. 2*a*. The blocks or logic connection points 200, 201, 202, 203, 204, 205, 208 and 209 correspond in terms of their function to the blocks in FIG. 2*a* designated with the same numbers. In contrast with FIG. 2*a*, however, the adaptation in block 206 in FIG. 2*b* determines a plurality of correction factors which each correspond to an output variable of the wall film compensation 203. In this case, the block 206 generates a correction factor fukak, for the briefly acting output teukk of the wall film compensation block 203, and a correction factor fukal, for the output teukl which acts over a longer period. The factors fukak and fukal are multiplied, at logic connection points 210 and 211, by the respective output variables of block 203. The outputs of the points 210 and 211 are then combined at the logic connection point 205 to form an overall correction signal teukg for non-steady-state operation.

Figure 3:
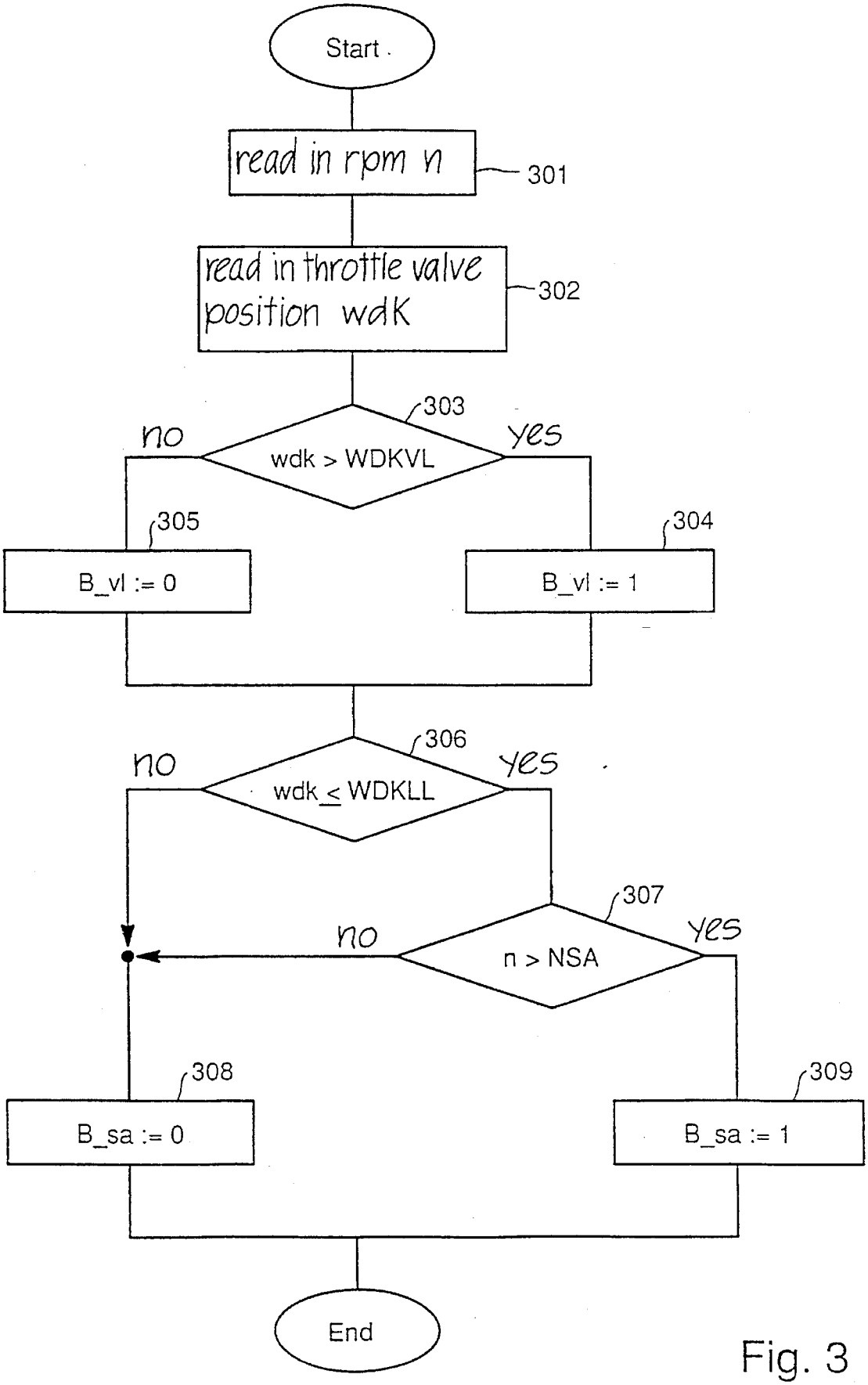
FIG. 3 is a flow-chart illustrating the detection of full load and thrust deactivation operating states, in accordance with the present invention.

In FIG. 3 a simple method for determining the "full load" and "thrust deactivation" operating states is described. The method illustrated in FIG. 3 is run through repeatedly within a fixed time frame (typically 10 ms). Initially, at steps 301 and 302, the rpm n and the throttle valve position wdk are determined from the corresponding output signals of the sensors 111 and 118.

In step 303, the throttle valve angle wdk is compared to a threshold value WDKVL to determine whether the throttle valve is fully opened. If this is the case, a flag B_vl for identifying full load operation is set in step 304. If the throttle valve is only partially opened, the full load flag B_vl is cleared in step 305.

In step 306, it is determined whether the throttle valve is closed, i.e. whether the throttle valve angle is smaller than or equal to the idling position WDKLL of the throttle valve. When the throttle valve is closed, operation proceeds to step 307 in which it is determined whether the engine is running at a high rpm by comparing the rpm n to a threshold NSA. The typical threshold value NSA for thrust deactivation is 1500 rpm. If the rpm n is greater than the threshold value NSA, the condition for thrust deactivation B_sa is set in step 309. If it is determined at step 306 that the throttle valve is not in the idling position, or if the rpm n is below the thrust cut off rpm NSA, as determined at step 307, thrust deactivation is not carried out, i.e., B_sa is reset at step 308.

Figure 4A:
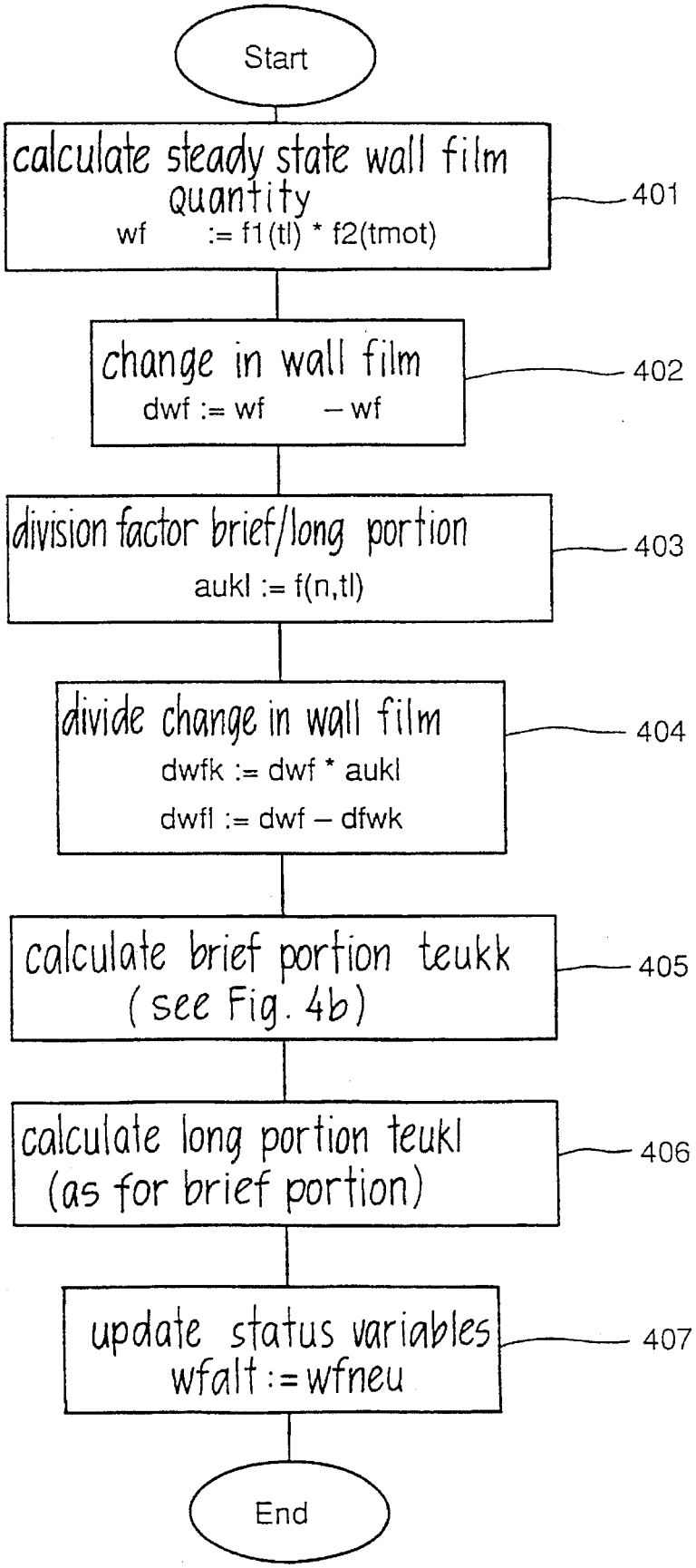
FIGS. 4*a* and 4*b* are flow-charts illustrating a method for wall film compensation in accordance with the prior art.
Figure 4B:
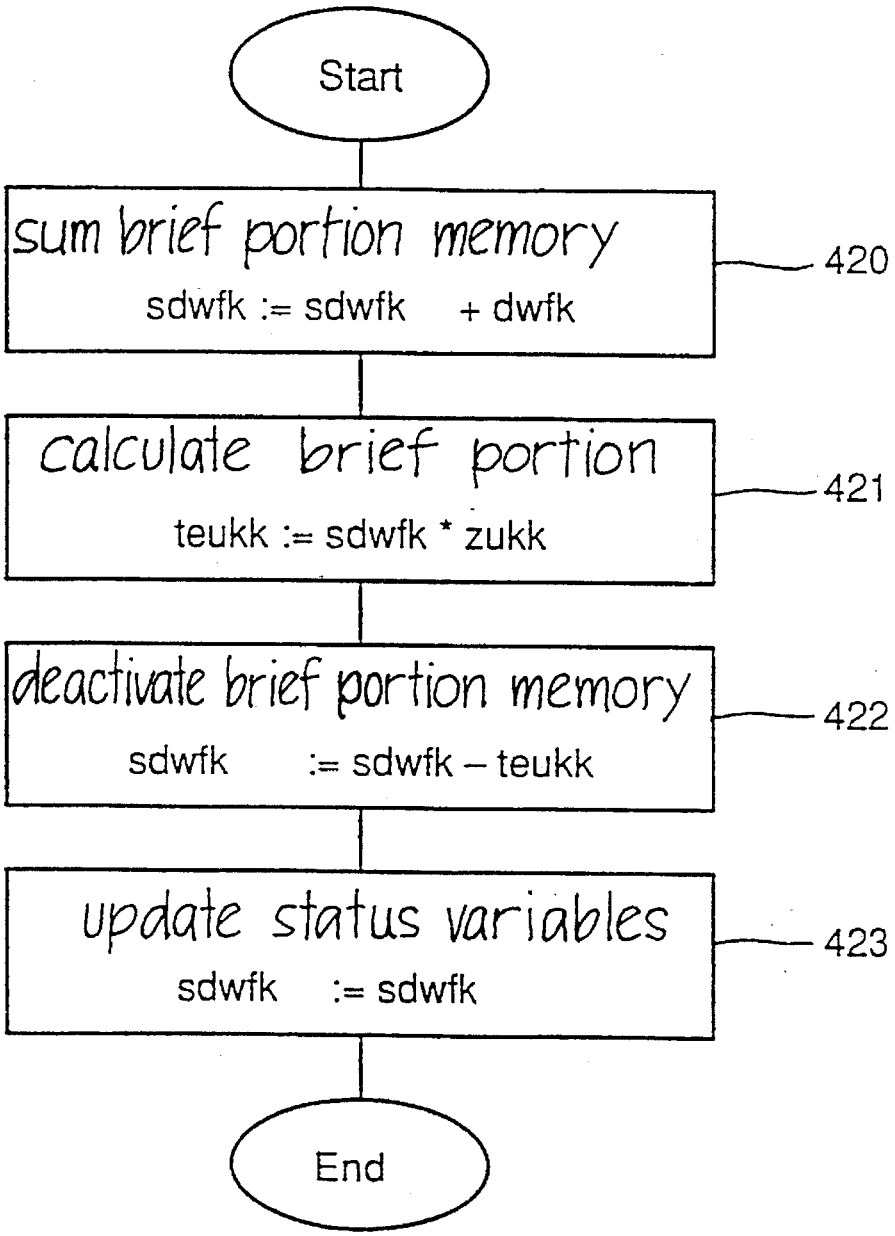

The flow-charts in FIGS. 4*a* and 4*b* show a method for wall film compensation. The procedure in FIG. 4*a* is normally segment-synchronous, i.e. it is run through once per ignition.

In FIG. 4*a*, in step 401, initially the quantity of wall film which is associated with the respective engine state and is obtained during steady-state operation is determined. This quantity of wall film can be calculated, for example, approximately as a product of a load-dependent and a temperature-dependent factor. The factors as functions of tl and tmot can be stored as value tables in a ROM.

In step 402, the change in the steady-state quantity of wall film is determined in two successive computing steps. The change dwf in wall film must be distributed as an additional quantity of fuel to the subsequent injections in order to compensate the build up of wall film. For this purpose, in step 403, a division factor aukl is initially determined as a function of the rpm n and the load tl. Using the division factor aukl, which can assume a value of 0% to 100%, the quantity of wall film calculated in step 402 is divided, in step 404, into a brief portion dwfk and a long portion dwfl. The brief portion dwfk is distributed over a very short period after the change in load (typically 4–5 injections). In contrast, the long portion dwfl is injected over a significantly longer time range. As a result, with a corresponding selection of the division factor aukl, the distribution over time of the quantity of fuel dwf to be additionally injected can be adapted to the dynamic behavior of the wall film.

In steps 405 and 406, the injection time corrections teukk and teukl corresponding to the brief portion and to the long portion are determined. The calculation procedure for the brief portion teukk is explained in detail in FIG. 4*b*. The calculation of the long portion teukl in step 406 takes place in a corresponding way but with a different selection of parameters to that in step 405.

In step 407, the steady-state quantity of wall film determined in step 401 is finally stored in the variable wfalt which is used in the next iteration of the procedure for the calculation of the change in the wall film.

FIG. 4*b* is a flow-chart illustrating the calculation of the brief portion teukk in step 405 in the flow-chart of FIG. 4*a*.

In step 420, the portion dwfk of the change in the wall film which is to be compensated by means of the brief portion is initially added to the contents of a brief portion memory. The brief portion memory contains the additional quantity of fuel which still has also to be injected as the brief portion. Since the brief portion is to be distributed over a plurality of injections, the brief portion memory contains the residual portion of changes in wall film which originates from directly preceding changes in load and has not yet been injected.

In the subsequent step 421, the portion teukk of the brief portion memory which is to be added to the next injection is determined by multiplying sdwlk by the reduction factor zukk. The factor zukk is stored in the ROM and is adapted to the respective engine. A typical value for zukk is 0.25, i.e., in each computing step, 25% of the brief portion memory is injected as te correction.

The brief portion memory is subsequently reduced by the removed and injected portion teukk at step 422. In step 423, the new value of the brief portion memory is finally stored in the variable sdwfkalt, which constitutes the residual quantity of fuel to be taken into account in further injections.

The calculation of the long portion teukl (step 406 in FIG. 4*a*) takes place in a corresponding way. However, instead of the reduction factor zukk a substantially smaller reduction factor zukl is used having a typical value of approximately 0.015. In each computing step, 1.5% of the long portion memory is therefore injected. Thus, the long portion memory acts over a significantly longer period of time.

Figure 4C:
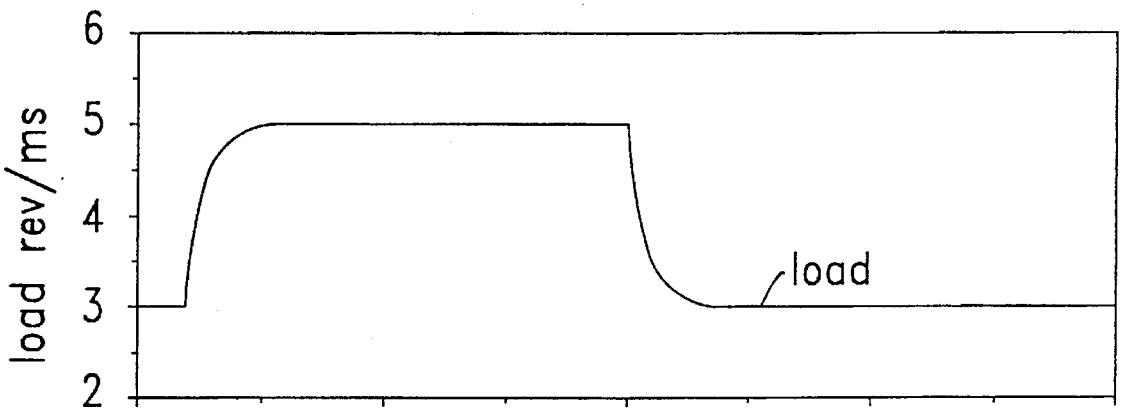
FIG. 4*c* shows the variation over time of load and injection time during non-steady-state operation which results from the wall film compensation method of FIGS. 4*a* and 4*b*.
Figure 4C:
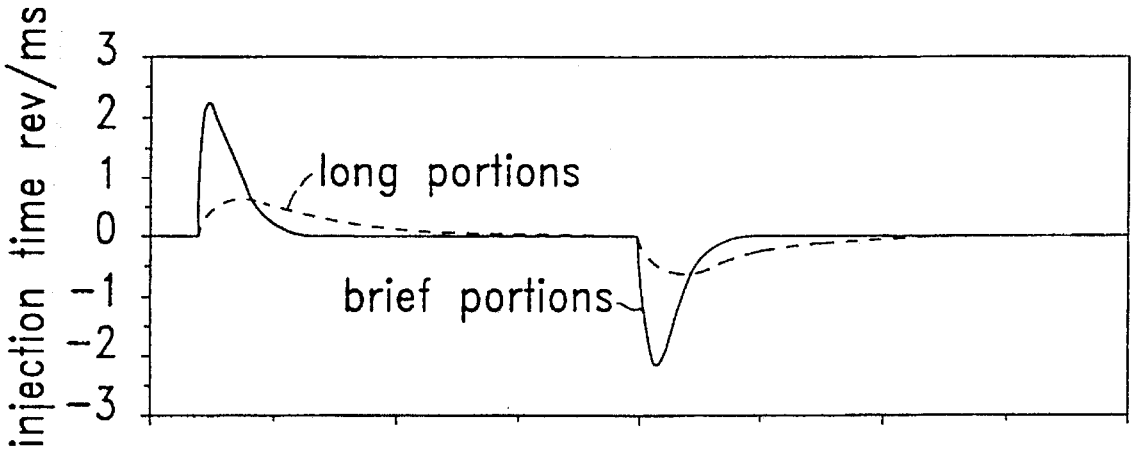
Figure 4C:
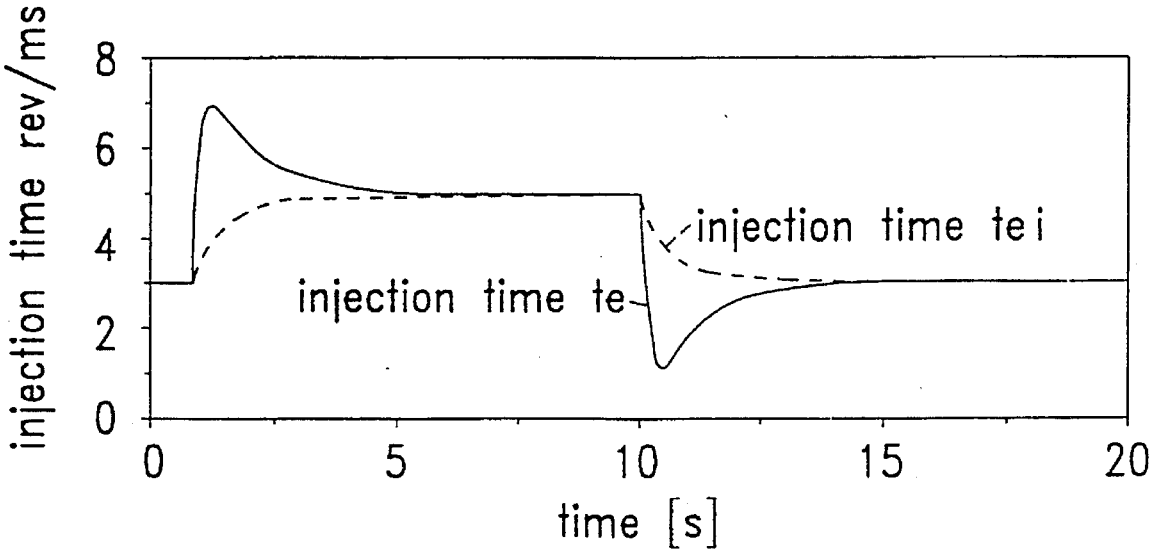

FIG. 4*c* shows, by way of example, the variation in te which results from a change in load, on the basis of the methods shown in FIGS. 4*a* and 4*b*. Here, it has been a requirement that the lambda control factor fr (block 202, FIGS. 2*a* and 2*b*) and the correction factors of the adaptive non-steady-state control (block 206 in FIGS. 2*a* and 2*b*) are equal to 1.

The upper diagram of FIG. 4*c* shows an exemplary variation of the load signal over time. In this case, an acceleration is followed by a subsequent deceleration. During acceleration, the quantity of wall film increases. This build up of wall film must be corrected by an additional increase in the injection time. During the subsequent deceleration, the wall film is reduced again. The quantity of fuel which is released during this process leads to an enrichment of the mixture, for which reason during the deceleration the injection time must be reduced beyond the value corresponding to the lower load.

The middle diagram of FIG. 4*c* shows the variation of the brief portion teukk (solid line) and of the long portion teukl (dotted line) of the wall film compensation as follows from the procedures of FIGS. 4*a* and 4*b*.

The lower diagram shows the variation in the injection time. The dotted line corresponds to the variable tel in FIGS. 2*a* and 2*b*, i.e., the injection time which corresponds to the current air charge. As a result of the wall film compensation, the injection time is additionally increased during the acceleration by the addition of the brief portion and long portion and additionally decreased during the deceleration. As a result, the signal te (solid line) rises above the uncorrected signal te1 and corresponds to the signal te1 only during the steady-state phases appreciably after the changes in load.

Figure 5A:
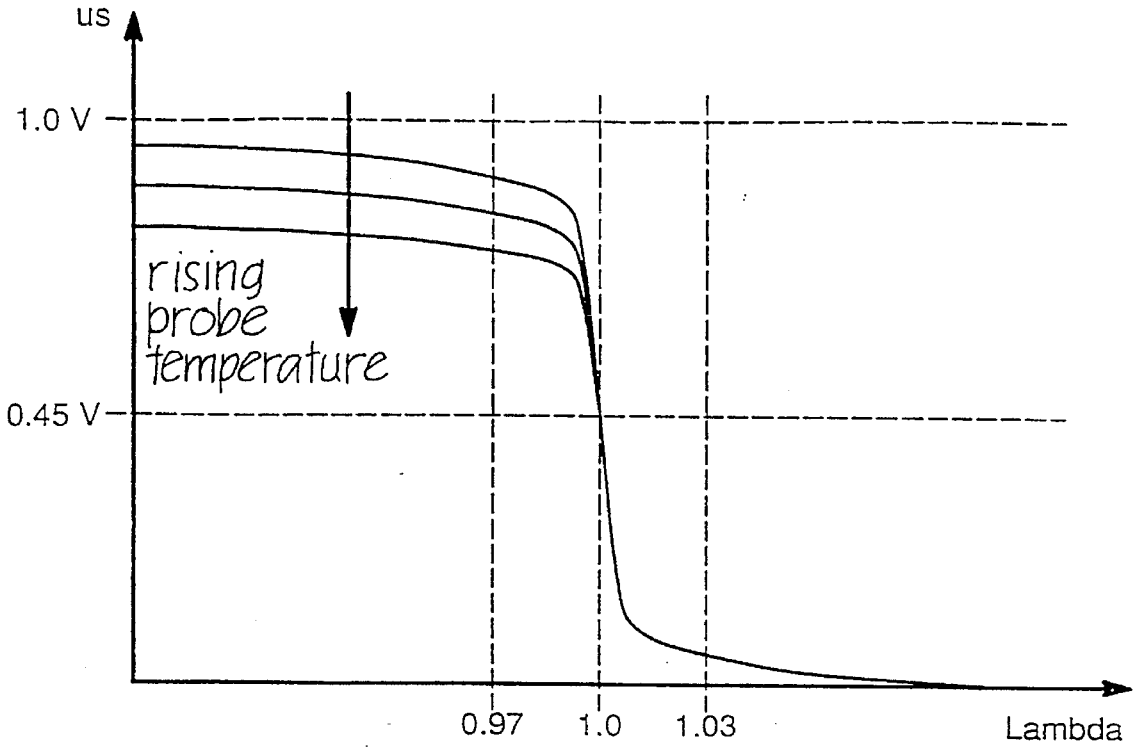
FIG. 5*a* illustrates, with reference to the characteristic curve of a Nernst probe, the problems which arise when determining a linear lambda signal using such a probe.

FIG. 5*a* illustrates a typical characteristic curve of an oxygen probe such as is used for mixture control. The characteristic curve shows a marked two-state behavior. For a lean mixture (lambda>1.03) or for a rich mixture (lambda<0.97) the probe output voltage us hardly changes with changes in the mixture. Therefore, even small errors in the measured probe voltage lead to a large error in the determination of the air/fuel ratio. In addition, there is a strong dependence on temperature of the characteristic curve in the rich mixture region. The probe temperature can be determined by measuring the internal resistance of the probe, but this requires additional circuitry in the control device. In the method for lambda control illustrated in FIGS. 5*b* to 5*e*, the probe voltage is tested only to determine whether it lies above or below 450 mV, which corresponds to the stoichiometric mixture. As a result, periodic control oscillation occurs whose average value is at lambda=1.0.

Figure 5B:
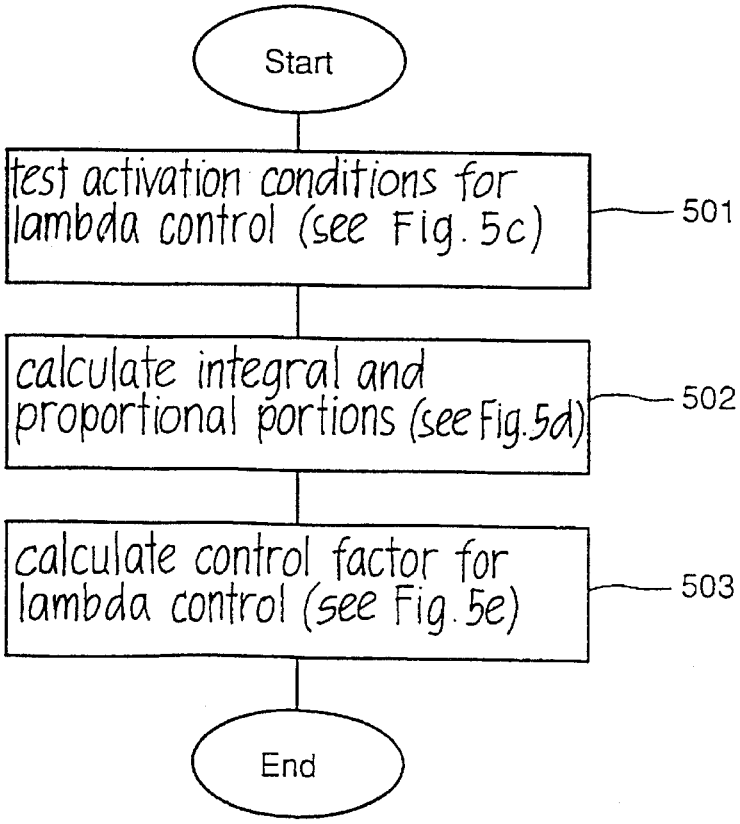
FIG. 5*b* is a high-level flow-chart of a two-point lambda control method.

FIG. 5*b* shows an overview of the lambda control in accordance with the present invention. The object of the lambda control is to set, on average, an air/fuel ratio with a lambda of 1 during steady-state operation. The main steps 501–503 of the lambda control process depicted in FIG. 5*b* are as follows. Step 501 entails determining whether the lambda control function has been activated and is described in further detail below in connection with FIG. 5*c*. Step 502 entails calculating certain integral and proportional portions of the lambda control function and is described in further detail below in connection with FIG. 5*d*. Step 503 entails calculating the control factor fr of the lambda control and is described in further detail below in connection with FIG. 5*e*.

Figure 5C:
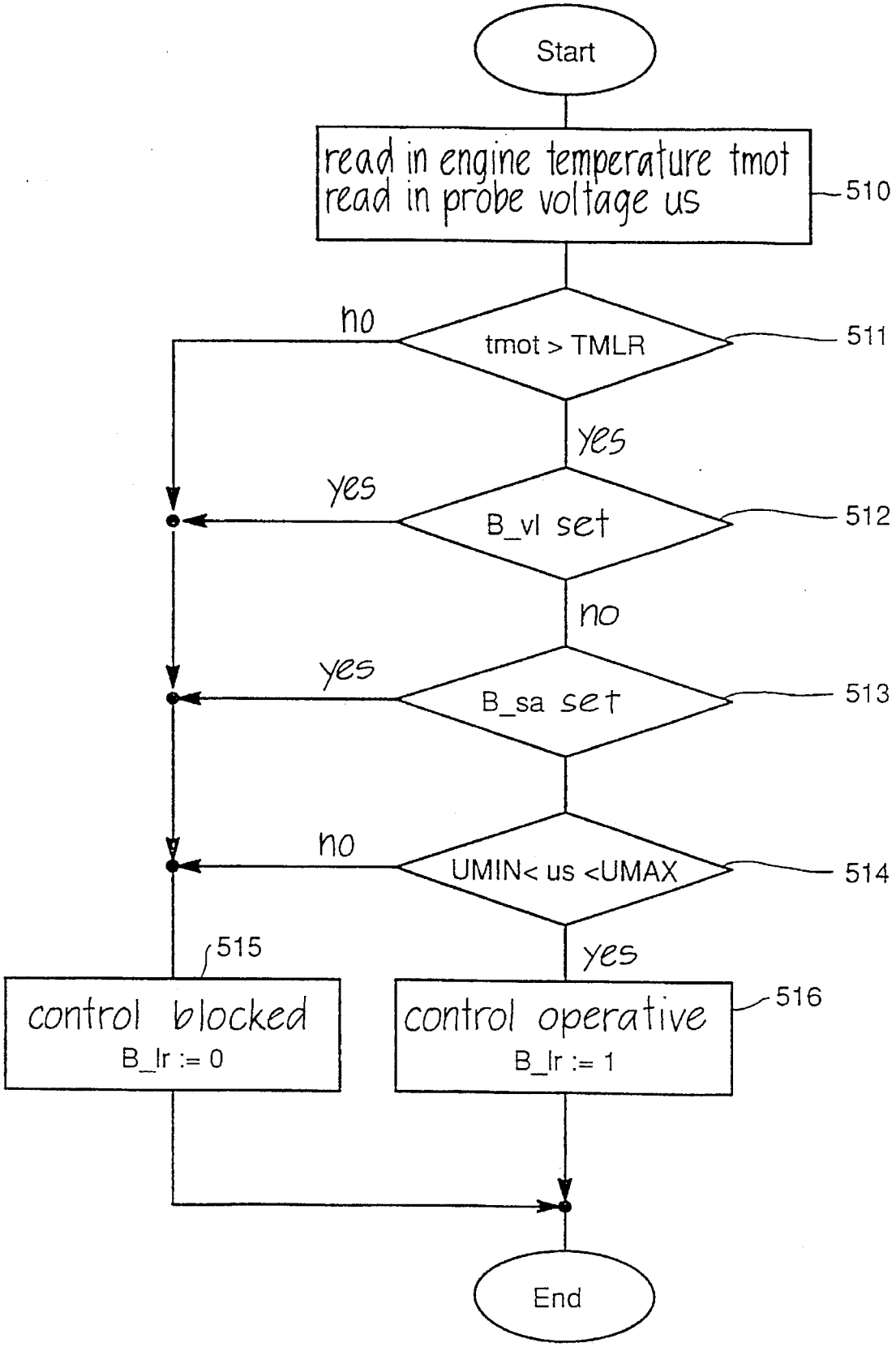
FIG. 5*c* is a flow-chart illustrating the conditions which have to be fulfilled for the lambda control of the present invention to operate.

FIG. 5*c* shows the conditions which have to be fulfilled for the lambda control to operate. The procedure illustrated is typically run through in a time frame of 10 ms. Initially, in step 510, the engine temperature tmot and the lambda probe temperature us are read in from the corresponding sensors 119 and 116.

During warming up of the engine, a rich air/fuel mixture is usually desired. The lambda control, which sets a stoichiometric mixture, must therefore not be active during this time. At step 511, the engine temperature tmot is tested to determine whether it has exceeded a specific threshold value TMLR. If this is not the case, operation branches to step 515 in which the lambda control is switched off by clearing a corresponding flag B_lr.

Likewise, during full load operation, a rich mixture is frequently switched over to in order to protect the exhaust gas manifold and the catalytic converter against thermal overloading. In this case as well, the lambda control must not be active. In step 512, the flag B_vl (see FIG. 3) is tested to determine whether the full load condition is present. If this is the case, operation branches to step 515 and the lambda control is thus switched off.

In order to prevent the correction factor fr of the lambda control from running up against the upper limit during thrust deactivation, in step 513 the flag B_sa is tested to determine whether thrust operation is present. If B_sa is set, operation branches to step 515 and the lambda control is switched off.

Finally, in step 514, the output signal us of the lambda probe is tested to determine whether it is a plausible signal. In the simplest ease, this step is carried out by comparing the probe output voltage us with a lower limit value UMIN and an upper limit value UMAX. If it is determined in step 514 that the probe voltage us lies outside this range, operation branches to step 515 in which B_lr is set to 0.

If all of the above-described conditions are fulfilled, i.e., the engine temperature is higher than the threshold value, there is no full load and no thrust deactivation, and the lambda probe is generating a valid output signal, the lambda control is switched on in step 516 by setting the flag B_lr to 1.

Figure 5D:
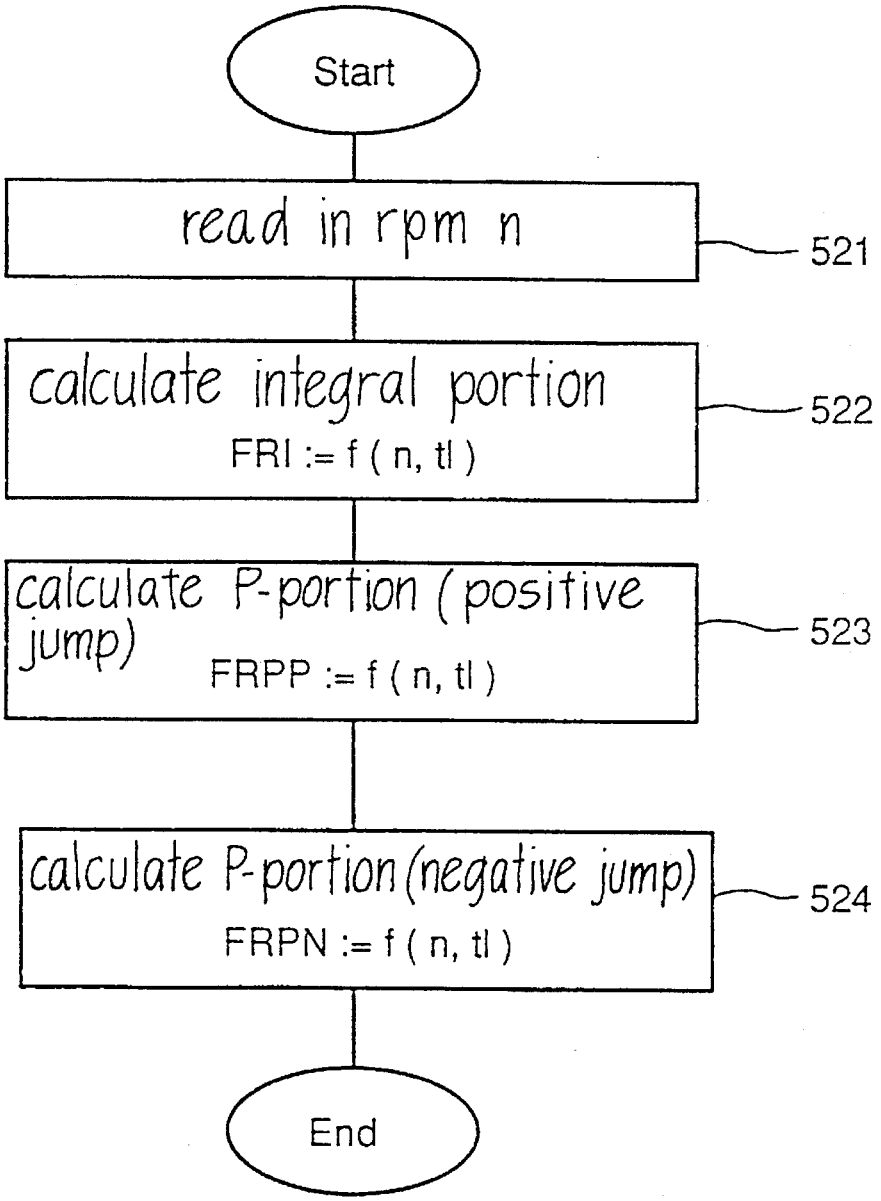
FIG. 5*d* is a flow-chart illustrating the calculation of proportional and integral portions of the lambda control of the present invention.

The operating-point-dependent parameters of the lambda controller are determined by the procedure diagramed in FIG. 5*d*. Initially, at step 521, the rpm n is determined from the output signal of the sensor 118. Subsequently, in steps 522, 523 and 524, the integral portion FRI, the P portion for positive P jump FRPP and the P portion for negative P jump FRPN are determined as a function of the rpm n and the load tl. The values for these three parameters are determined from tables stored in the ROM.

Figure 5E:
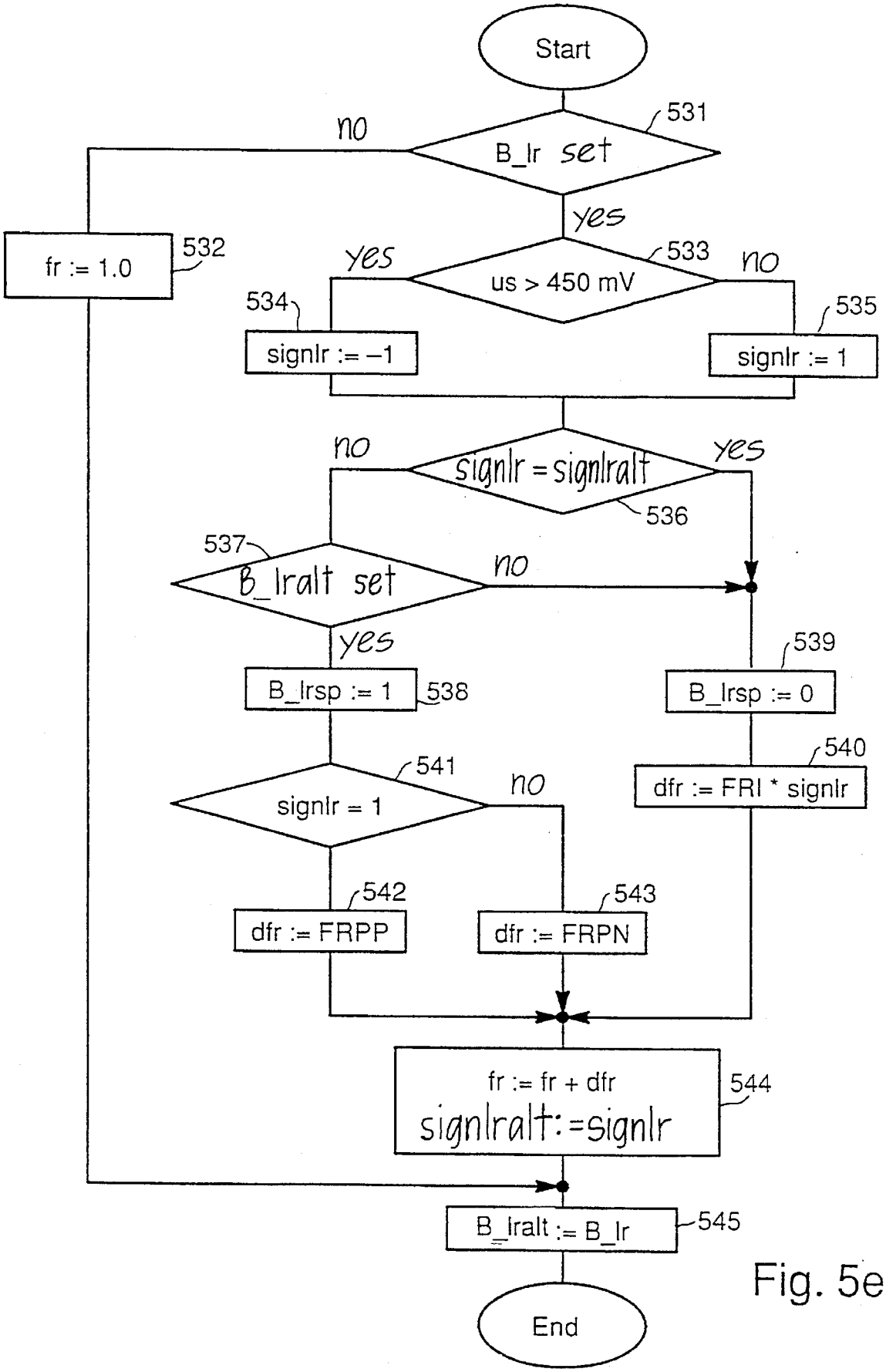
FIG. 5*e* is a flow-chart illustrating the determination of a correction factor fr which ensures a constant air/fuel ratio during steady-state operation.

In FIG. 5*e*, a procedure for determining the control factor fr is illustrated. The procedure described is also run through in a fixed time frame of typically 10 ms.

In step 531, the flag B_lr is tested to determine whether the lambda control has in fact been enabled (see FIG. 5*c*). If the lambda control has not been enabled, operation branches to step 532 in which the control factor fr is set to its neutral value 1.0. Subsequently, in step 545, the value of the flag B_lr is stored in the variable B_lralt because it will be required again in the next program run.

If in step 531 it is determined that the lambda control is operative, operation proceeds to step 533 in which it is determined whether the probe voltage us lies above or below the threshold value 450 mV which corresponds to the stoichiometric mixture (i.e., lambda=1). The result of this interrogation is stored in the variable signlr. If us>450 mV, i.e., mixture is rich, signlr is set to −1 in step 534. Otherwise, signlr is set to 1 in step 535, signifying a lean mixture. At step 536, it is determined whether signlr has changed since the last iteration of the of the procedure of FIG. 5*e* by comparing signlr to signlralt which holds the value of signlr from the previous iteration. If the value of signlr has changed, operation proceeds to step 537 in which it is determined whether the lambda control was active in the previous iteration, i.e., whether the value of signlr was determined correctly in the previous iteration. If this is the case, a so-called "probe jump" has occurred, i.e., the mixture has changed from the lean side to the rich side, or vice versa. This probe jump is marked in step 538 by setting the flag B_lrsp. The B_lrsp flag is required in the adaptation of the wall film compensation described below.

If it is determined in the next step 541 that the mixture is now lean (i.e., signlr=1), the change dfr which has to be added to the control factor fr is set to be equal to the positive P jump FRPP. If, in contrast, it is determined in step 541 that the mixture is too rich (i.e., signlr is not equal to 1), dfr is set to the value of the negative P jump FRPN in step 543.

If the probe voltage has not passed through the 450 mV point, i.e., it is determined in step 536 that signlr=signlralt, the flag B_lrsp for the probe jump is cleared in step 539. In addition, the change dfr of the control factor is set, in step 540, to be equal to the product of the I portion FRI and the value of the variable signlr. If the mixture is too rich (i.e. signlr=−1), a negative increment dfr of the control factor, and thus a reduction in fr, results. Conversely, a lean mixture (i.e., signlr=1) leads to a positive increment and thus to an enrichment. The same takes place if it has been determined in step 537 that the lambda control was not yet active in the previous computing iteration (i.e., B_lralt is not set), since then the variable signlralt does not contain a meaningful value and therefore the passing of the probe voltage through 450 mV can not be detected.

In step 544, the change in the control factor dfr is added to the value of the control factor fr and the value of signlr is stored in the variable signlralt for the next computing cycle. Subsequently, in step 545, as in the case in which the lambda control is not ready, the value of the flag B_lr is also stored for the next program iteration.

Figure 5F:
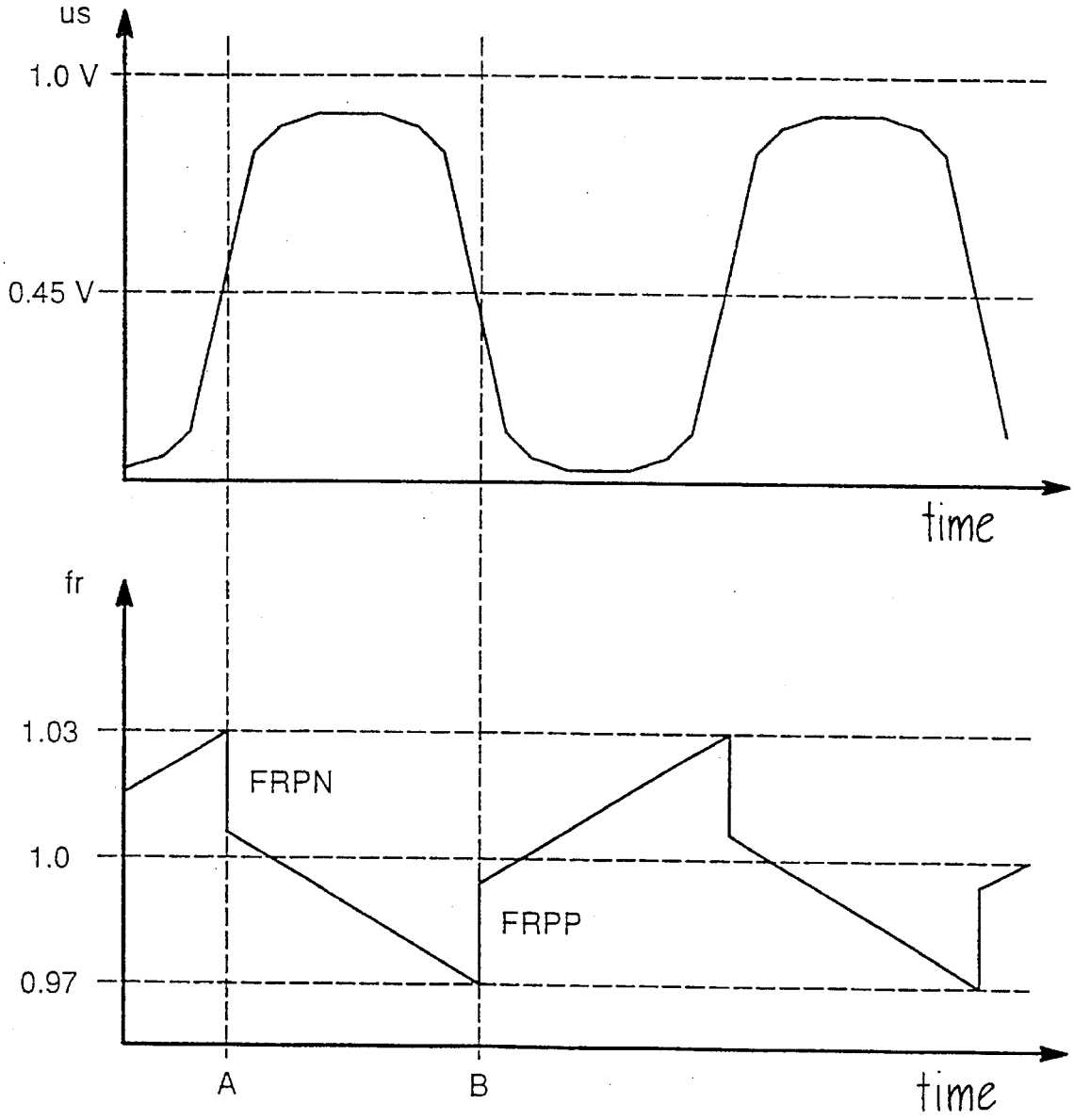
FIG. 5*f* shows the variation over time of the lambda probe signal and control factor fr which is obtained during steady-state operation on the basis of the control method of FIGS. 5*b* through 5*e*.

FIG. 5*f* shows the variation over time of the control factor fr and probe voltage us which is obtained with the control procedure described above. A probe jump from a lean to rich mixture takes place at the time A. The lambda control reacts to the probe jump by reducing the control factor fr initially by addition of the negative p jump FRPN. Subsequently, the control factor is slowly reduced further in accordance with the value of the I portion. When the control factor reaches its neutral value 1.0, no probe jump is immediately detected because the stoichiometric mixture has not yet arrived at the lambda probe due to the delay time in the system (attributable to working cycles of the engine and gas travel times to the lambda probe). Therefore, the factor fr is further decremented until after the end of the delay time a probe jump is detected again at time B. Since the mixture is now clearly too lean, the positive P jump FRPP, which is intended to adjust the control factor as quickly as possible to the proximity of its neutral value, is initially added. Subsequently (in accordance with the preceding time section A-B), the control factor is slowly increased until a transition to a rich mixture is detected again.

By suitably selecting the parameters (I portion and P portion), a control oscillation amplitude of approximately 3% is achieved.

FIG. 6*a* shows the variation over time of the control factor during an exemplary acceleration and explains the mode of operation of the adaptive wall film compensation with reference to this example. Here, it has been assumed that the build up of wall film has increased in comparison with the new state. The rise in load therefore causes the mixture to become leaner, which the lambda controller tries to compensate.

During time segment A-B, the fault does not yet effect the control factor. The control factor shows the normal deviation of 6%. After drawing in, combusting and expelling the mixture which is leaner because of the change in load and after the travel time of the exhaust gas to the probe, the controller is disrupted during time segment B-C. In order to compensate for the fact that the mixture has been made leaner, the controller must make the mixture significantly richer than would occur within the usual 6% control factor deviation range. If a change in load is detected in the same segment B-C, the system concludes that there has been a change in the build up of wall film and the correction factors for wall film compensation are correspondingly adapted. In order to be able to assign the amplified control range and the change in load with correct timing, it is however necessary to correct the load signal by the delay time between injection and lambda measurement (broken line in upper diagram of FIG. 6*a*).

Since the lambda fault decays again because of the increased build up of wall film in the steady-state phase following the change in load, the control factor returns to its original range in the time segment C-D. In this case, the control range is also significantly more than 6%. However, there is no adaptation here of the wall film compensation since there is no change in load during the segment C-D.

FIG. 6*b* shows a flow-chart for performing a delay time correction of the load signal which is required for the adaptation of the wall film parameters. (See discussion relating to FIG. 6*a*). The procedure or routine of FIG. 6*b* is run through every 10 ms.

The delay time between the injection of a given air/fuel mixture to the corresponding lambda measurement is composed of two portions, namely, a delay time because of the working cycles of the engine (drawing in, compression, combustion, expulsion), which delay time is dependent only on the rpm of the engine; and a delay time due to the travel time of exhaust gases from the output valve to the lambda probe, which delay time is dependent on the air flow rate and thus on the load.

Correspondingly, in step 601, a delay time tt is determined as a function of rpm and load. This approach permits both portions of the delay time, described above, to be modeled. The values of the delay time are stored for different values of rpm and load in a table in the ROM.

In the following step 602, the load signal tl is delayed with the delay time tt determined in step 601.

Figure 6C:
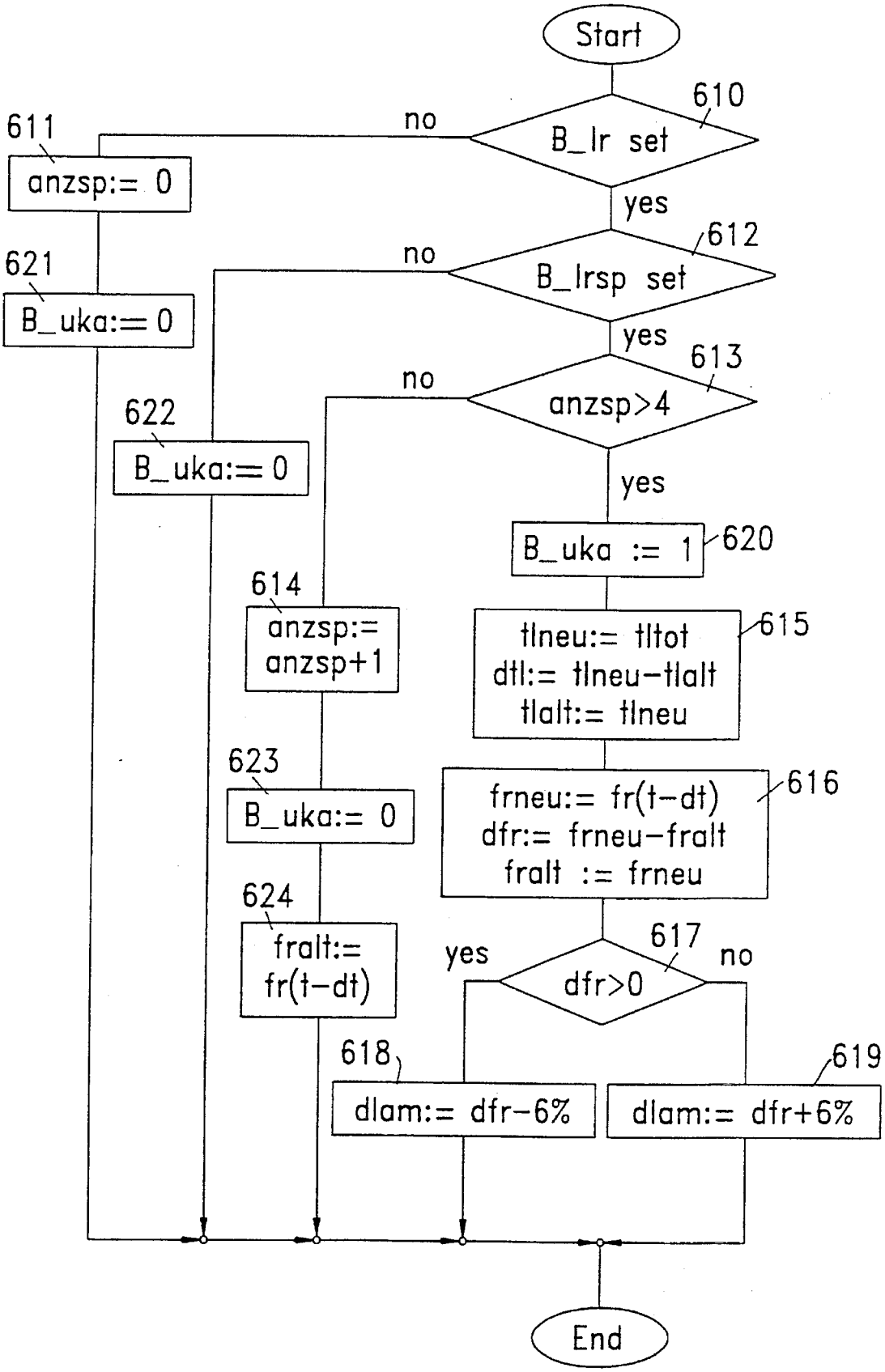
FIG. 6*c* is a flow-chart illustrating a procedure for determining the change in load and estimating a mixture deviation given the control factor fr.

FIG. 6*c* is a flow-chart of a method for determining the change dtl in a load between two probe jumps of the lambda control and an estimated value for the mixture deviation dlam. The procedure of FIG. 6*c* is also run through every 10 ms.

Figure 6D:
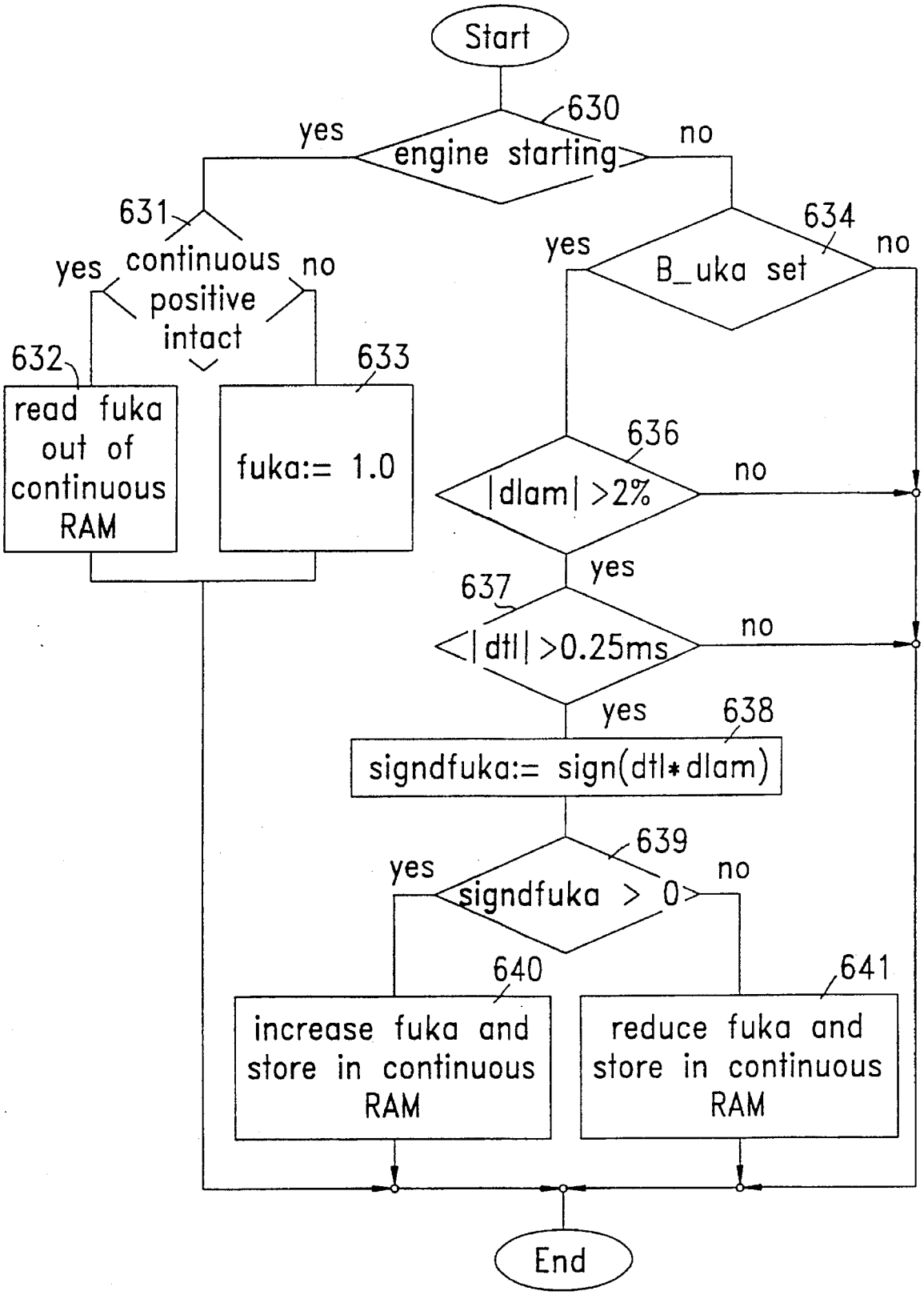
FIG. 6*d* is a flow-chart illustrating a correction of the wall film compensation.

A precondition for the adaptation of the wall film parameters according to the method of FIG. 6*c* is that the lambda control is operating correctly. Therefore, in step 610, the flag B_lr is tested to determine whether the lambda control is operative (i.e., B_lr=1; see FIG. 5*c*). If this is not the case, a counter anzsp is cleared in step 611. Operation then proceeds to step 621 in which a flag B_uka is reset. In this manner, a following procedure, depicted in FIG. 6*d*, is informed that it has not been possible to calculate a change dtl in load or a mixture deviation dlam. After step 621, the procedure of FIG. 6*c* is terminated.

If it is determined in step 610 that the lambda control is operating correctly, operation proceeds to step 612 in which it is determined whether a probe jump has occurred, i.e., whether the probe voltage has passed through the 450 mV level. Since the load and the control factor are only evaluated at the probe jumps, no further processing is needed when in step 612 it is determined that the flag B_lrsp is clear. In this case, the flag B_uka is reset in step 622 before the procedure is terminated.

If it is determined in step 612 that a probe jump has been detected, operation proceeds to step 613 in which it is determined whether a specific number of probe jumps have occurred (typically 4 probe jumps) since the lambda control was switched on. This waiting time is necessary in order to wait for the transient recovery of the lambda control, for example, after thrust deactivation. Therefore, if a sufficient number of probe jumps have not yet been detected, operation branches to step 614 in which the counter anzsp for probe jumps is incremented by 1. Furthermore, in step 623, the flag B_uka is cleared since, in this case also, no valid values for the change in load and for the deviation of the control range from the normal value have been determined. The control factor is buffered in a variable fralt for use in the next probe jump for the calculation of the control range. However, here the value of the control factor fr(t−dt), which is one computing step behind, is stored because the instantaneous value fr(t) already contains the P jump added at the time of the probe jump. (The time dt corresponds to the computing increment of 10 ms).

If in step 613 it is determined that a sufficiently large number of probe jumps have already occurred since the switching on of the lambda control, the flag B_uka is set in step 620, thereby indicating that a valid calculation of the change in load and of the control range was able to be carried out. In the subsequent step 615, the change, since the last probe jump, in the delay time-corrected load signal tltot is calculated. The instantaneous load value is stored in the variable tlalt in order to be able to determine the change in load again at the next probe jump.

In step 616, the control range dfr is determined. However, here the instantaneous value of the control factor fr(t) must not be used as a basis since the corresponding P jump is already contained in this value (see FIG. 5*e*). Instead, the value fr(t–dt), which is one computing step behind, is used. The control factor frneu is also stored in the variable fralt until the next probe jump.

In steps 617 through 619, the deviation of the control range from its normal value (in the fault-free state) is calculated. This deviation is a measure of the air/fuel ratio which would occur without lambda control and therefore is a measure of the size of the fault. In step 617, it is initially determined whether the control range is positive or negative. In the case of a positive control range, operation proceeds to step 618 in which dlam, the deviation from the normal value, is determined to be:

$$dlam := dfr - 6\%,$$

it being a precondition that the control range is 6% during fault-free operation. If, for example, the control factor runs 8% in the rich direction, instead of the expected 6%, a deviation of 2% results. It is therefore possible to assume that without lambda control, the adjustment to lean would have been set to lambda=1.02. The deviation dlam of the control range from the normal value can accordingly be used directly as an approximation for the deviation of the mixture from lambda=1.0. Correspondingly, in the case of a negative control range, operation proceeds instead to step 619 in which dlam, the deviation from the normal value, is determined to be:

$$dlam := dfr + 6\%.$$

FIG. 6*d* shows how the correction factor fuka for the wall film compensation is determined from the change in load dtl calculated in FIG. 6*c* between two instances when the probe voltage passes through 450 mV and the mixture deviation dlam. The program of FIG. 6*d* is called up in the same time frame as the program of FIG. 6*c*, i.e., every 10 ms. Initially, in step 630, it is determined whether the engine is already running or is still starting. When the engine is starting, it is checked in step 631 whether the continuous voltage supply of the control device is intact. If no fault in the continuous voltage supply has been detected, operation proceeds to step 632 in which the value fuka which was detected during the preceding iteration is read out from a battery-backed RAM. If, in contrast, it is determined in step 631 that the continuous supply was faulty, operation proceeds to step 633 in which the factor fuka is reset to its neutral value.

When it is determined in step 630 that the engine is running, operation branches to step 634 to determine whether the flag B_uka is set, i.e. whether the preceding program of FIG. 6*c* has determined valid values for the change in load dtl and for the mixture deviation dlam. If this is not the case, the program of FIG. 6*d* is terminated.

If valid values for the change in load and for the deviation of the control range are present, operation then proceeds to step 636 in which it is determined whether the estimated mixture deviation dlam is more than 2%. If this is not the case, there is evidently no appreciable mixture fault and the program is terminated. In the case of an estimated mixture deviation dlam of more than 2%, operation proceeds to step 637 in which it is determined whether a change in load has been detected at the same time. If it is determined at step 637 that the change in load since the last probe jump is smaller than a prescribed threshold value, the mixture deviation must have been caused by another fault and must not be due to a changed wall film behavior. In this case, the program of FIG. 6*d* is terminated.

If both a change in load and a mixture deviation are present, operation proceeds to step 638 in which the direction in which the correction factor fuka has to be adjusted is initially determined. If the change dtl in load and mixture deviation dlam are positive (i.e., adjustment in the lean direction with increasing load), the correction of the injection time calculated by the wall film compensation in block 206 (see FIG. 2*a*) is obviously too low and the correction factor fuka must be increased. In the case of a deceleration (negative dtl), an excessively low wall film compensation would lead to enrichment and thus to a negative value of dlam since the injection time is not reduced sufficiently far to compensate for the fuel evaporating from the wall film. In contrast, in the case of acceleration, excessive wall film compensation results in enrichment (i.e., dtl is positive, dlam is negative) and deceleration leads to adjustment in the lean direction (dtl is negative, dlam is positive). Obviously, the wall film compensation must therefore be increased when dtl and dlam have the same sign while it must be reduced when dtl and dlam have different signs. At step 638, a variable signdfuka is determined which has the same sign as the sign of the product (dtl*dlam).

In step 639, if it is determined that signdfuka is positive, fuka is increased in step 640 and stored in the battery-backed RAM. If, however, signdfuka is not positive, fuka is reduced in step 641 and stored in the battery-backed RAM. The newly calculated factor fuka is stored in the battery-backed RAM so that after the engine is shut off and started again, a correct value for the factor fuk is already available.

Several alternatives to the embodiments of the present invention described above are possible within the scope of the present invention.

In FIG. 6*a*, a very short and steep change in load is illustrated as an example. Without a delay time correction of the load signal, it would not be possible to detect a change in load in the time segment B-C, i.e., in the region of the faulty fr variation. However, significantly flatter load slopes in which a change in load occurs even in the interval B-C also arise in real driving situations. As a result, a delay time correction as in FIG. 6*b* can be dispensed with. The method for the correction of the wall film compensation therefore becomes significantly simpler.

In a variant of the method illustrated in FIGS. 6*b*–6*d*, instead of determining the mixture deviation dlam from the control range dfr (see FIG. 6*c*, steps 616–619), the time periods between two successive half-cycles of the control factor fr can be used to detect a fault in the air/fuel ratio. During fault-free operation, the ratio of the time period ts of the rising half-cycle to the time period tf of the falling half-cycle has a constant value. By virtue of the adjustment to lean shown in FIG. 6*a*, the time code ts of the rising half-cycle (B-C) is lengthened to a large degree while the preceding falling half-cycle (A-B) is not influenced. Accordingly, in step 636 of FIG. 6*d*, the deviation of the ratio of the time periods V=ts/tf from the ratio Vo during fault-free operation can be used instead of the mixture deviation dlam. In step 638 of FIG. 6*d*, the variable signdfuka is accordingly determined as sign (dtl×(V−Vo)).

A disadvantage of the method illustrated in FIGS. 6*b*–6*d* becomes clear in FIG. 6*a* if it is assumed that the load slope progresses in such a flat way that a rise in load can still be detected even in the time section C-D in which the control factor runs back to its normal level. Since during the calculation of the control range and of the mixture deviation according to FIG. 6*c* only the change in the control factor from time C to time D is considered and the prehistory is not taken into account, at the probe jump at point D a control range of approximately −9% and thus a mixture deviation of dlam=−3% results. If it was still possible to detect a rise in load in the time segment C-D, this would incorrectly lead to a reduction in the factor fuka.

Figure 7A:
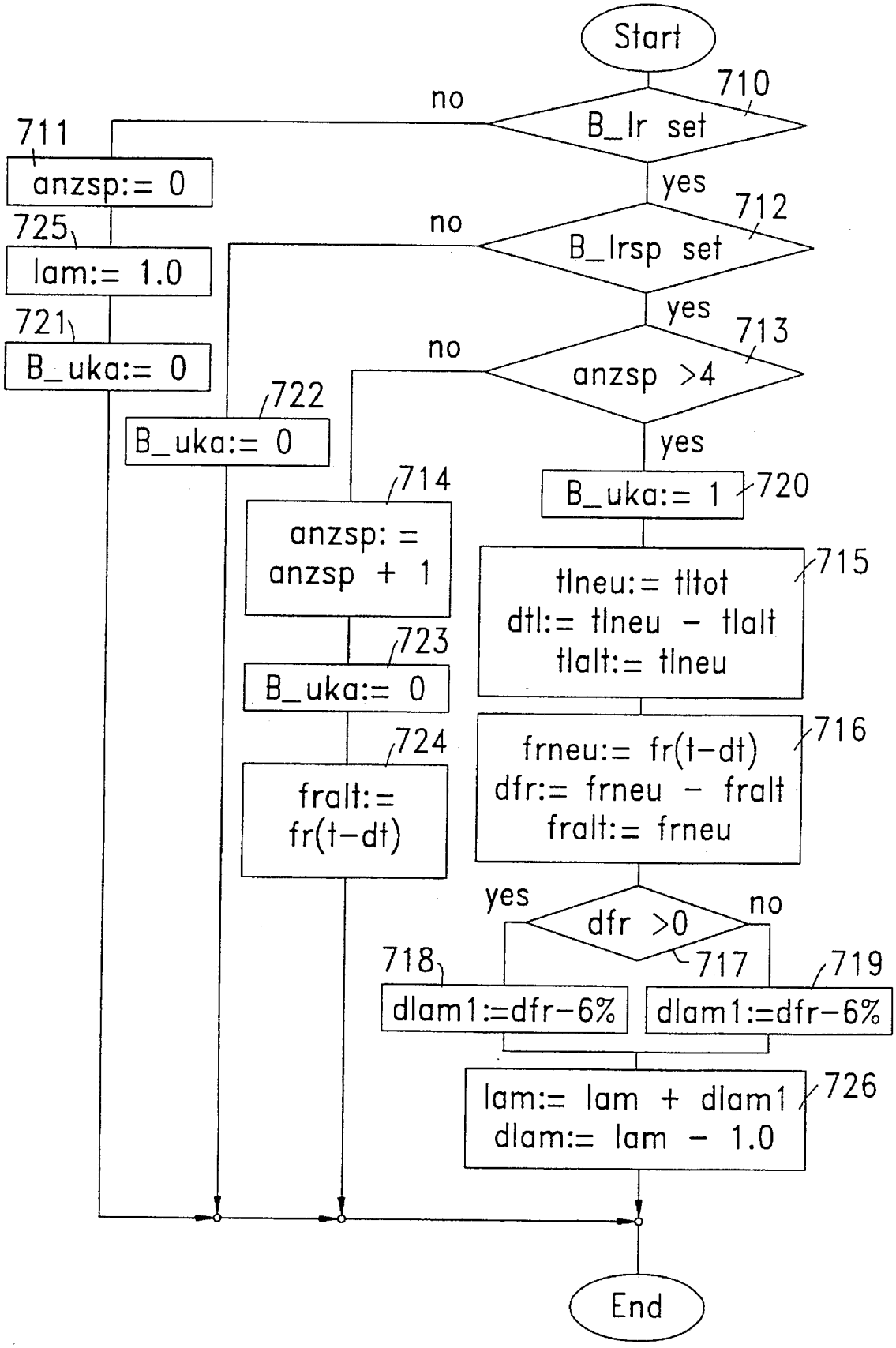
FIG. 7*a* is a flow-chart illustrating a variant of the procedure of FIG. 6*c*.

The aforementioned problem is avoided by the procedure shown in FIG. 7*a*. The routine of FIG. 7*a* replaces the routine of FIG. 6*c* for calculating the mixture deviation dlam and the change in load dtl. The difference in the procedure of FIG. 7*a* from that of FIG. 6*c* consists in the fact that initially an absolute value lam for the mixture is estimated which would occur with the lambda control switched off. From this estimated value, the deviation of the mixture dlam is obtained by subtraction from 1.

The steps 710–716 and 720–724 correspond to the respective processing steps 610–616 and 620–624 in FIG. 6*c* and will not be described here again. In step 717, the control range dfr calculated in step 716 is tested to determine whether it is positive or negative. If the control range is positive, the change in the mixture with respect to the preceding probe jump is calculated in step 718 as the deviation of the control range dfr from the normal value of approximately 6% as follows:

$$dlaml := dfr - 6\%.$$

If, for example, the control range is 8%, the mixture would obviously have to be enriched by a further 2% than in the fault-free state. Accordingly, an adjustment of 2% in the lean direction is concluded. In the case of a negative control range dfr, the change in the mixture dlaml is determined in step 719, as follows:

$$dlaml := dfr + 6\%.$$

In step 726, the absolute value of the mixture is subsequently estimated by adding the change in the mixture since the last probe jump dlaml to the old estimated value for the mixture. The mixture deviation dlam is then determined by subtracting 1.0 from the absolute value lam.

If it is determined in step 710 that the lambda control is not operative, i.e. the B_lr flag is not set, operation branches to step 711 which is followed by step 725 in which the estimated value for the mixture is set to its neutral value 1.0.

Figure 7B:
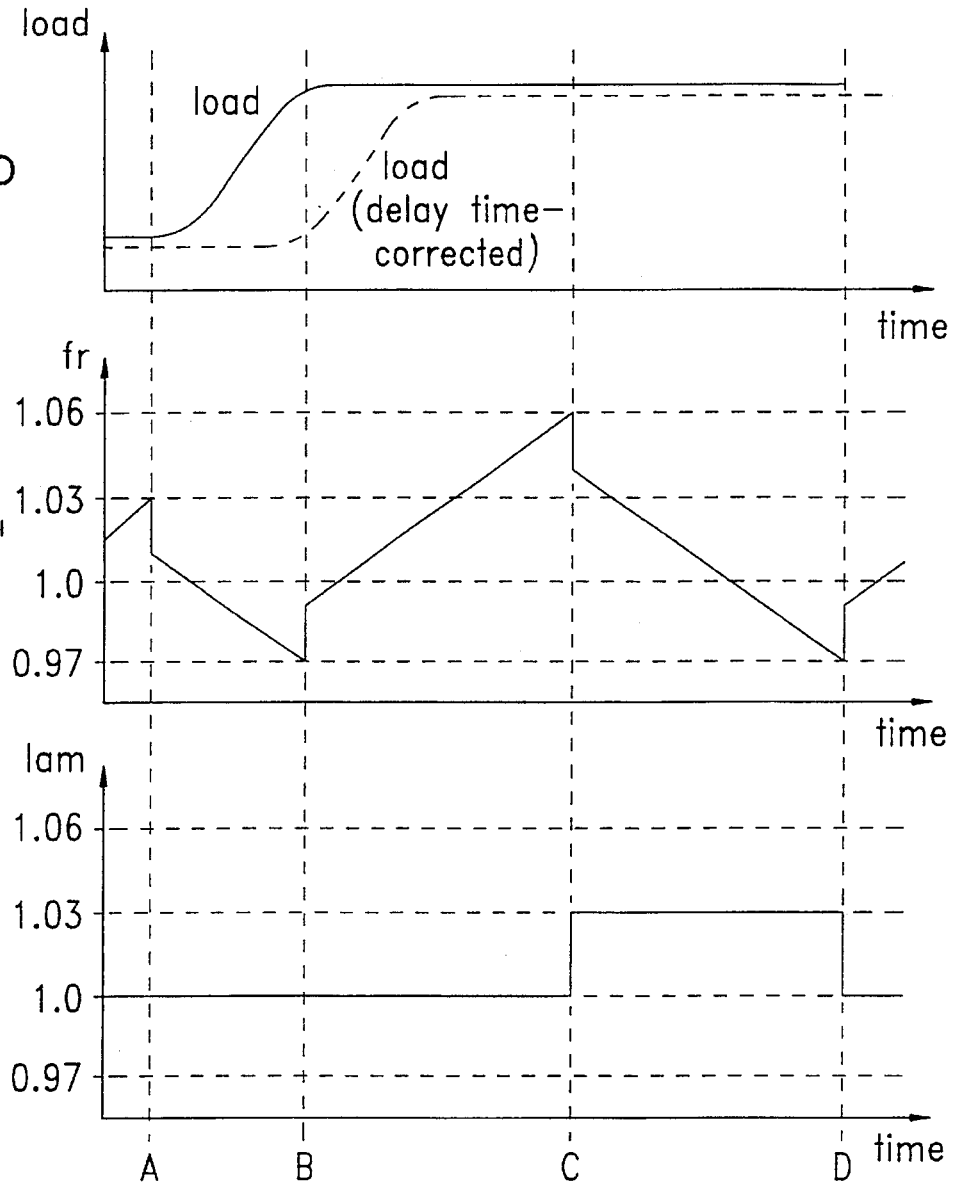
FIG. 7*b* shows variations in load, the value fr and a resulting estimated value lam for the air/fuel ratio, over time.

FIG. 7*b* shows the same variations in the load and in the control factor fr as shown in FIG. 6*a*. In the case of the fr variation shown in FIG. 7*b*, initially a positive control range of 9% would be detected at the time C. This results in a 3% change in the mixture in the interval B-C. Because the estimated lambda value lam was 1.0 during the preceding fault-free steady state operation, at the time C an estimated value of lam=1.03 is calculated. During the reversing of the lambda controller in the interval C-D, a control range of −9% is calculated at the probe jump at point D, and from this a change in mixture dlaml of −3% is calculated. The absolute value lam is thus reset again to the value 1.0. However, the system does not conclude at any time that the mixture is rich. Thus, a correction of the factor fuka in the wrong direction is prevented.

Brief faults which have already decayed again before the lambda control can react to them are not detected with the previously described method. A variant of the above-described method will now be described, with reference to FIGS. 8*a*–8*f*, which is based on the evaluation of the probe voltage us. As explained with reference to FIG. 5*a*, measuring the air/fuel ratio by linearization of the characteristic curve of the lambda probe is very difficult. However, very severe faults in the air/fuel ratio can also be detected from the probe voltage itself. For this purpose, it is necessary to determine initially the minimum and maximum values of the probe voltage which occur during fault-free operation. There is a fault in the mixture if the probe voltage drops significantly below or exceeds these two limits.

Figure 8A:
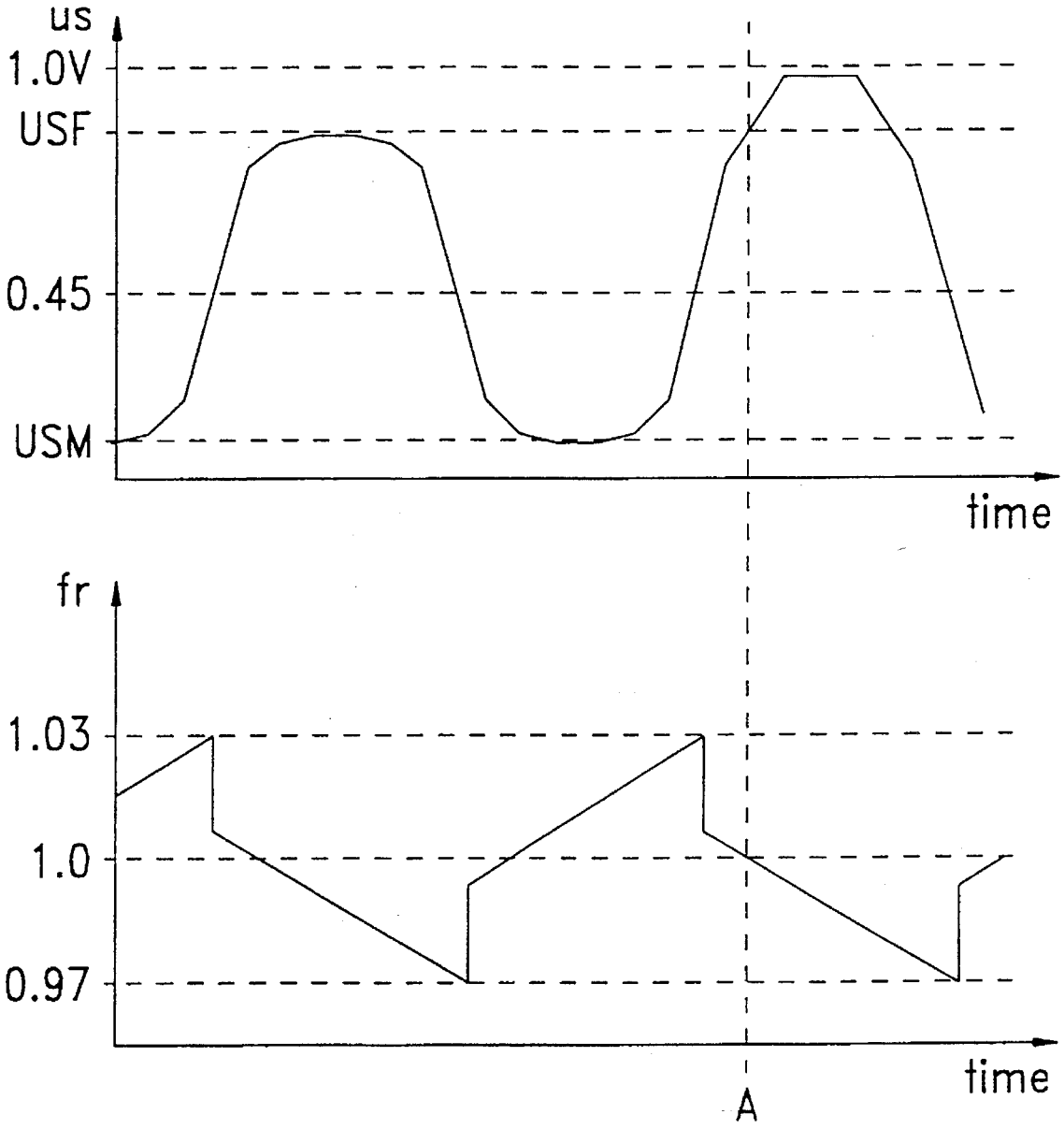
FIG. 8*a* illustrates a brief mixture fault which only influences the probe voltage but does not influence the control factor fr of the lambda control.

FIG. 8*a* graphically depicts the variation of the probe voltage us and of the control factor fr. Initially, the probe voltage us and the control factor fr are shown during fault-free steady-state operation, in which the probe voltage oscillates between the extreme values USF (the maximum value for a rich mixture) and USM (the minimum value for a lean mixture). At a time A, a significant rich fault of the mixture occurs. This fault leads to a brief rise in the probe voltage beyond the value USF which does not however lead to a corresponding change in the fr variation.

Figure 8B:
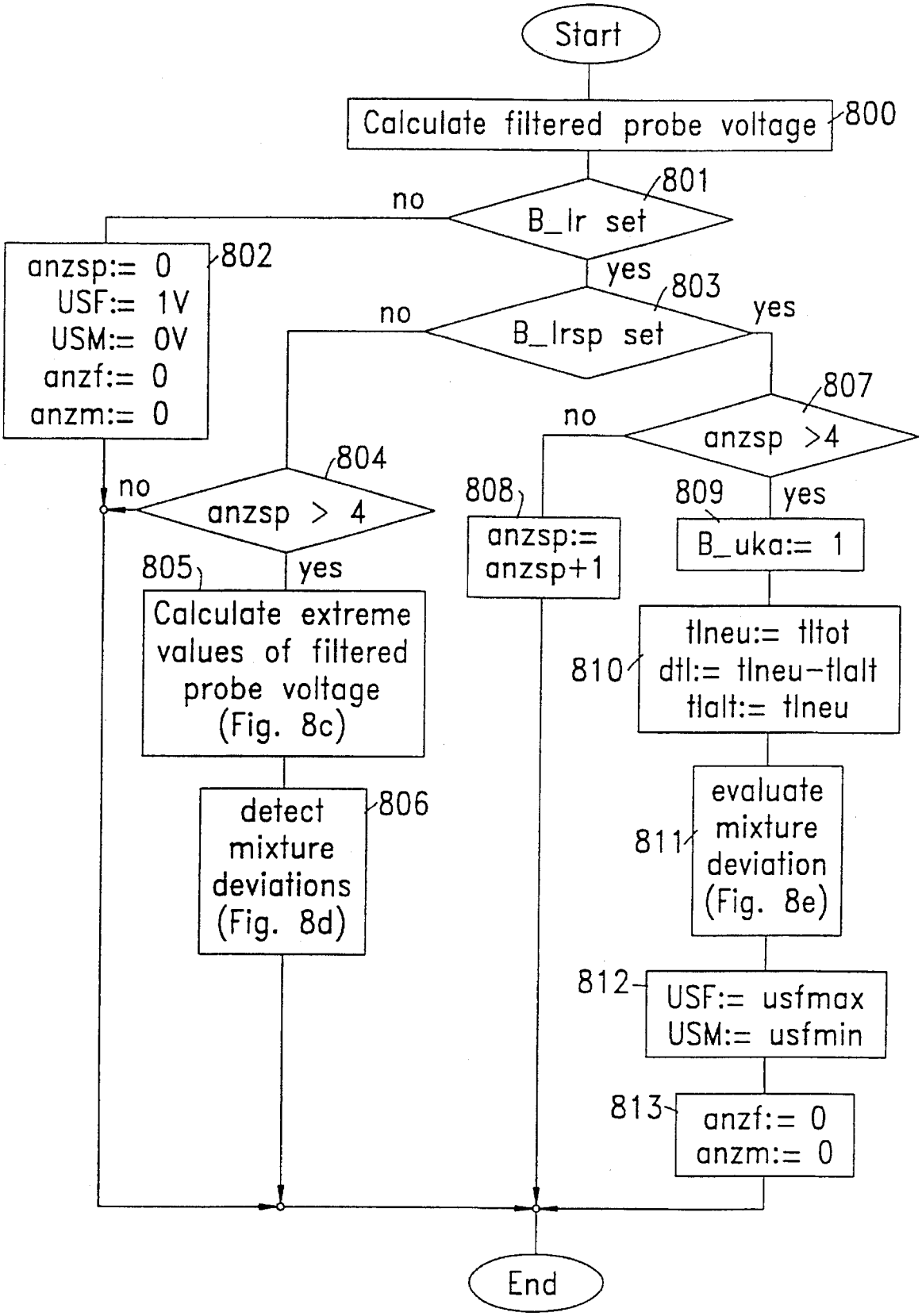
FIG. 8*b* is a flow-chart illustrating a further variant of the procedure of FIG. 6*c*. in which the probe signal of a Nernst probe is used instead of the control factor fr.

FIG. 8*b* shows a flow-chart of a routine for determining the change in load between two probe jumps and the detection of relatively large lambda deviations from the probe voltage. The routine of FIG. 8*b*, which is intended to replace the routine of FIG. 6*c*, is typically called every 10 ms.

During the determination of the amplitude of the probe voltage during fault-free operation, in order to remove the effects of electrical faults of the probe signal and of fluctuations in the mixture caused by individual combustion, the filtered probe voltage usf is calculated in step 800. A common digital lowpass filter of the first order can be used for such filtering. It is then determined, in step 801, whether the lambda control is active since a periodic variation in the probe voltage only occurs when the lambda control is operating.

If the lambda control is not operative, operation branches to step 802 in which several counters are reset: 1) anzsp, which counts the number of probe jumps, 2) anzm, which counts the number of measured probe voltage values which drop below the usual minimum value of the probe voltage, and 3) anzf, which counts the number of measured probe voltage values which exceed the usual maximum value of the probe voltage. In addition, the estimated value USF for the maximum value of the probe voltage during fault-free operation and the estimated value USM for the minimum value of the probe voltage during fault-free operation are set to valid initial values, typically 1 V for USF and 0 V for USM). The routine is then terminated.

Figure 8C:
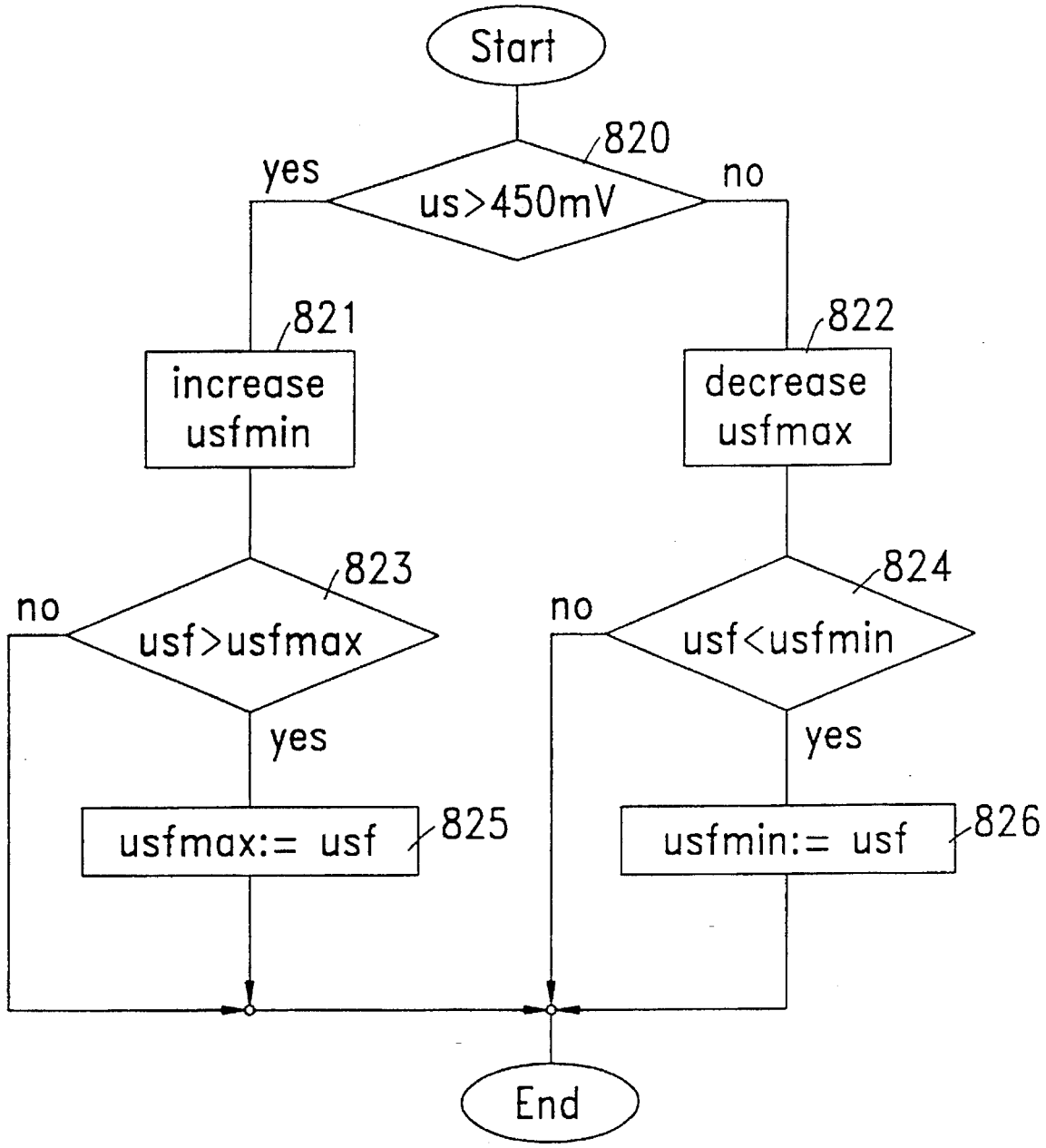
FIG. 8*c* is a flow-chart illustrating a procedure for determining the extreme values of the filtered probe voltage.

When it is determined in step 801 that the lambda control is operative, operation proceeds to step 803 in which it is determined whether a probe jump, i.e., a passing of the probe voltage through 450 mV, has been detected. If this is not the case, operation branches to step 804 in which it is determined whether more than four probe jumps have been detected since the lambda control was switched on. If not, the routine of FIG. 8*b* is terminated. If, however, at least 4 probe jumps have been detected, it can be assumed that the lambda control had sufficient time to settle at its normal control amplitude and operation proceeds to step 805. In step 805, in the interval between two probe jumps, the extreme values usfmin and usfmax of the lowpass-filtered probe voltage usf are determined. A procedure for carrying out step 805 is depicted in FIG. 8*c*. The extreme values of the filtered probe voltage are used in step 812 to correct USM and USF, the minimum and maximum values of the probe voltage during fault-free operation.

Figure 8D:
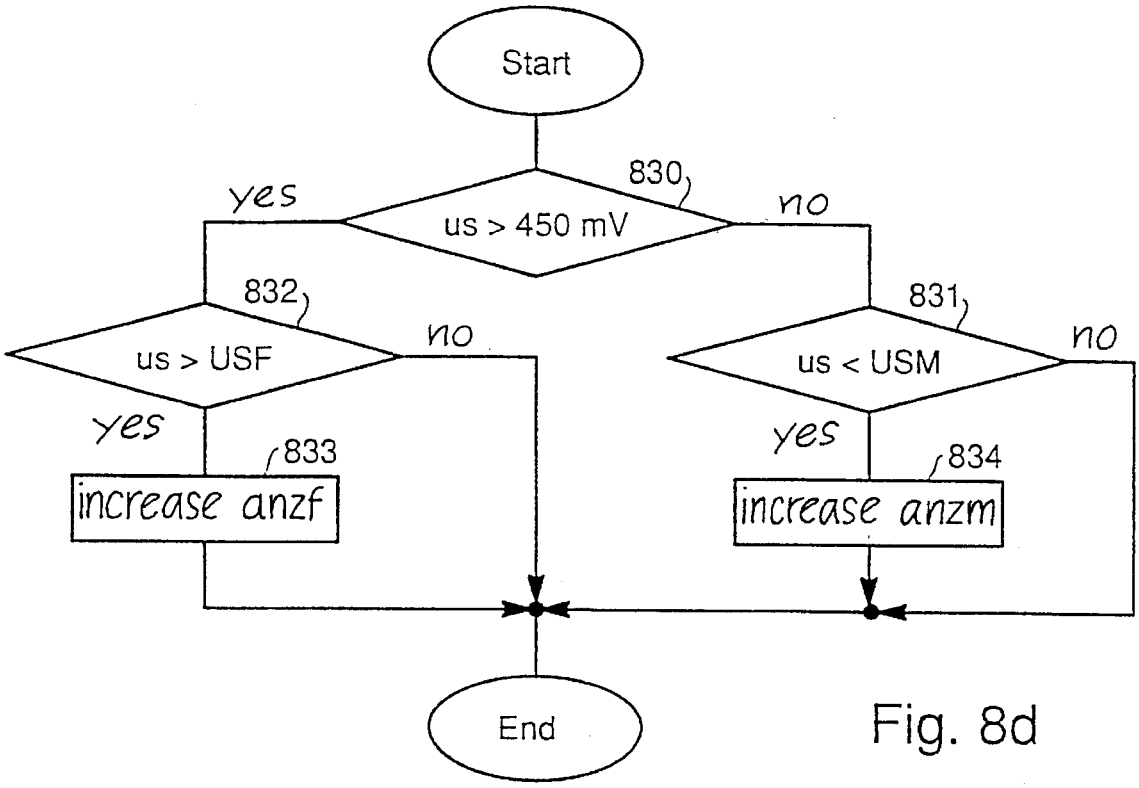
FIG. 8*d* is a flow-chart illustrating the detection of mixture deviations by comparison of the probe voltage with the amplitude of control oscillation in the normal state.

In step 806, mixture faults are detected by comparing the probe voltage with the usual minimum and maximum values USM and USF. A procedure for carrying out step 806 is depicted in FIG. 8*d*.

When it is determined in step 801 that the lambda control is operating, and when it is determined in step 803 that the probe voltage has passed through 450 mV, operation then proceeds to step 807 in which it is determined whether a sufficient number (four) of probe jumps have already been detected since the lambda control was switched on. If this is not yet the case, operation branches to step 808 in which the counter anzsp for probe jumps is incremented by one. The routine is then terminated.

If, however, it is determined in step 807 that more than 4 probe jumps have been detected, the flag B_uka is set in step 809, thereby indicating to subsequent functions that a valid value for the change in load and for the mixture deviation is present. In the subsequent step 810 (as also in FIG. 6*c*), the change in the load since the last probe jump is calculated. The load tltot delayed by the delay time is used in step 810. The instantaneous value of the load signal is stored in the variable tlalt until the next probe jump.

Subsequently, in step 811, the mixture deviations which were detected in step 806 in the interval between the probe jumps are evaluated. The method for this is described with respect to the flow-chart of FIG. 8*e*.

In step 812 the extreme values of the filtered probe voltage usfmax and usfmin are adopted as the maximum and minimum values of the probe voltage during fault-free operation, i.e., USF and USM, respectively. This correction is necessary since these values can change as a result of a changed probe temperature or as a result of a displacement of the characteristic curve of the lambda probe over its service life.

Finally, in step 813, the counters anzf and anzm, which count the number of measured values of the probe voltage which respectively exceed or drop below the extreme values USF and USM, are reset and the program is subsequently terminated.

The flow-chart of FIG. 8*c* depicts the procedure, represented by step 805 in FIG. 8*b*, for determining the minimum and maximum values of the filtered probe voltage. This procedure is called up every 10 ms, specifically in the interval between 2 probe jumps. Initially, in step 820, it is determined whether the probe voltage us exceeds 450 mV. If the mixture is initially in the "rich" phase of the control oscillation, i.e., us>450 mV, the minimum value of the filtered probe voltage is increased in step 821 by a small value, e.g., 0.1 mV. As a result, the minimum value is corrected upwards if, as a result of a characteristic curve displacement, the previously known minimum value usfmin is no longer reached. Subsequently, it is determined in step 823 whether the filtered probe voltage usf is higher than the previously known maximum value usfmax. If this is the case, the new value usf is saved as the maximum value usfmax, in step 825.

If, however, it is determined in step 820 that the probe voltage us does not exceed 450 mV, operation branches to step 822 in which the maximum value usfmax of the filtered probe voltage is reduced by a small amount.

As a result, the maximum value can be corrected downwards if the previous maximum value is no longer reached as a result of, for example, a characteristic curve displacement or a change in probe temperature. In step 824, it is determined whether the filtered probe voltage is lower than the previously known minimum value usfmin. If this is the case, the value of the filtered probe voltage is stored as a new minimum value in step 826.

In the procedure depicted by the flow-chart of FIG. 8*d*, the occurrence of a mixture fault is detected by comparing the probe voltage with the extreme values USM and USF during fault-free operation. The procedure, which is represented by step 806 in FIG. 8*b*, is executed every 10 ms in the interval between two instances of the probe voltage passing through 450 mV. Initially, it is determined in step 830 whether a "rich phase" (us>450 mV) or a "lean phase" (us<450 mV) is present. If us exceeds 450 mV, operation branches to step 832 in which the probe voltage is compared to the threshold USF, the maximum probe voltage which occurs during fault-free operation. If the probe voltage exceeds USF, the counter anzf is incremented in step 833. If, however, it is determined in step 830 that us does not exceed 450 mV, the probe voltage is compared with the lower threshold USM, in step 831. If the probe voltage drops below USM, the counter anzm is incremented in step 834. On the basis of the variables anzm and anzf, the number of measured values which go beyond the thresholds during fault-free operation, it is concluded in a subsequent program component whether the air/fuel mixture is to be enriched or adjusted in the lean direction.

Figure 8E:
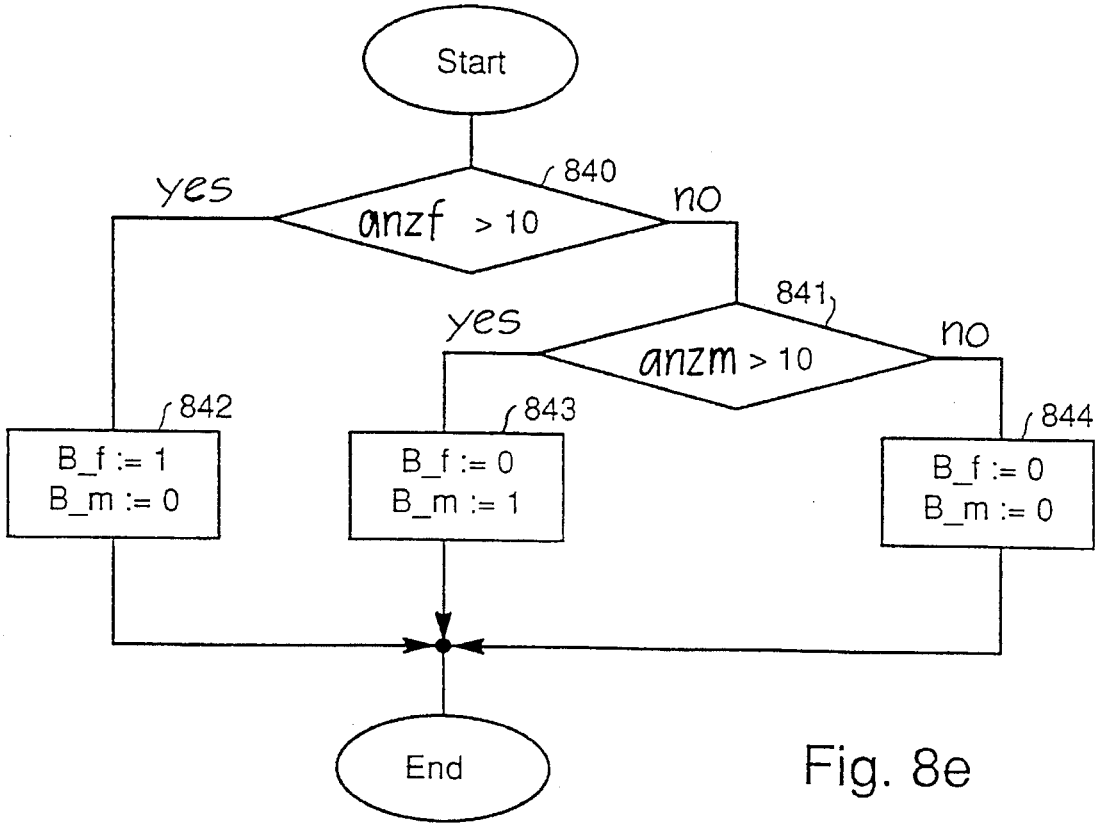
FIG. 8*e* is a flow-chart illustrating the evaluation of the mixture deviations shown in FIG. 8*a*.

FIG. 8*e* depicts a flow-chart describing a procedure for determining whether to enrich or adjust the air/fuel mixture in the lean direction. The procedure of FIG. 8*e*, which is represented by step 811 of FIG. 8*b*, is executed if a probe jump has been detected and if a sufficiently large number of probe jumps has occurred since the lambda control was switched on. If in step 840 it is determined that anzf, the number of measured values above the threshold USF since the last probe jump, is larger than a preselectable value, e.g. 10, significant enrichment is clearly present. Therefore, in step 842, a flag B_f is set thereby indicating enrichment and a flag B_m which corresponds to adjustment in the lean direction is cleared. If, in contrast, enrichment is not detected in step 840, it is determined in step 841 whether instead a larger number of measured values of the probe voltage lie below the threshold USM, i.e., whether anzm is greater than a preselectable value, such as 10. If this is the case, the flag B_f is reset in step 843 and the flag B_m which indicates adjustment in the lean direction is set. If neither a relatively large number of "rich" measured values nor a relatively large number of "lean" measured values are present, both flags B_f and B_m are cleared in step 844, since in that case a relatively large fault in the mixture has clearly not occurred.

Figure 8F:
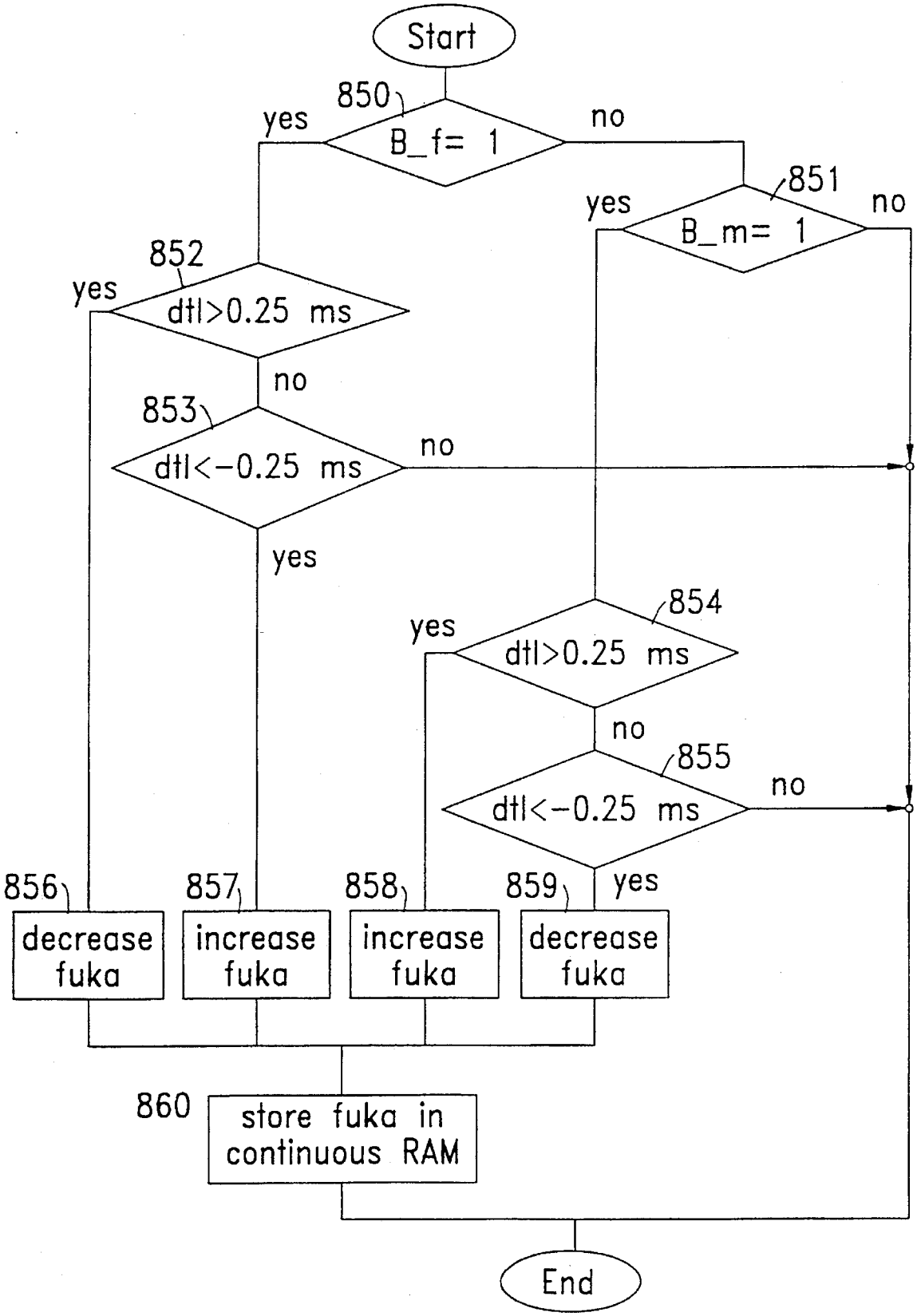
FIG. 8*f* is a flow-chart illustrating a variant of the correction procedure of FIG. 6*d* of the wall film parameters for the method of FIGS. 8*b* through 8*e*.

FIG. 8*f* depicts a procedure in which the system concludes from the flags B_f and B_m, which indicate a fault in the mixture, and from dtl, the calculated change in load since the last probe jump, whether a change in the correction factor fuka is necessary. The procedure depicted in FIG. 8*f* replaces the steps 636–641 in the procedure of FIG. 6*d*. If a rich fault is detected in step 850 (i.e., B_f=1), operation proceeds to step 852 in which the change in load dtl is tested next. If dtl is greater than a preselectable value, e.g. 0.25 ms, operation proceeds to step 856 in which the factor fuka is reduced, since in the case of acceleration enrichment has been detected and the wall film compensation is accordingly obviously too great. If, in contrast, a deceleration has been detected, i.e., it is determined in step 852 that dtl does not exceed the preselected threshold and it is also determined in step 853 that dtl is less than a negative preselectable threshold, then the factor fuka is increased in step 857.

If it is determined in step 850 that enrichment is not present, operation then branches to step 851 in which it is determined whether an adjustment to lean has been detected. If this is the case, and if it is also determined at step 854 that the change in load is positive, the factor fuka is increased in step 858, since in the case of an acceleration and an adjustment to lean, the wall film compensation is too low. If acceleration is not detected in step 854, it is determined in step 855 whether, instead, deceleration is present. If this is the case, the factor fuka is reduced in step 859.

If the factor fuka is changed in one of the steps 856, 857, 858 or 859, the new value of fuka is then stored in step 860 in the battery-backed RAM.

A further improvement can be achieved if, instead of the structure of FIG. 2*a*, the structure according to FIG. 2*b* is used. In FIG. 2*b*, two correction factors fukak and fukal are available which act separately on the brief portion and long portion of the wall film compensation, at multiplication points 210 and 211. In this case, it is suitable to determine the correction factor fukal, which influences the long portion teukl of the wall film compensation, using the method depicted in FIGS. 6*b*–6*d*, i.e., by evaluating the lambda control factor fr, since a fault in the long portion of the wall film compensation also leads to enduring mixture faults which influence the control range of the lambda controller in all cases. In contrast, the correction factor fukak, for the brief portion, can be determined by evaluating the probe voltage according to a method such as that illustrated in FIGS. 8*b*–8*f*. A faulty brief portion will also change the mixture only briefly so that detection is not always ensured by evaluating the control range.

At different ranges of engine temperature, different types of fuel frequently influence the wall film behavior in different ways. Thus, for example, when operating an engine with a fuel to which approximately 20% of ethanol has been added, a factor fuk of approximately 0.9 to 1.0 has to be set in order to adapt a wall film compensation to the new fuel, for a warm engine which has been tuned for commercially available winter fuel. In contrast, with an engine temperature of 20° C., a factor fuka of 1.4 is necessary. In this case, it is suitable to determine a separate value for the factor fuka for each of the different engine temperature ranges and then to use this value if the engine is warming up in the corresponding engine temperature range.

A further improvement in accordance with the present invention takes into account the aging of lambda probes which leads to an increase in the period duration of the lambda control and thus to an increase in the control range. In this case, it is advantageous not to compare the control range with a fixed value of, for instance 6% (for the fault-free test) in steps 618 and 619 in FIG. 6*c*, but rather to compare the control range with the control range dfr0 in the fault-free case which is continuously determined again. For this purpose, the control range dfr calculated in step 616 can always be stored as a normal control range, for example, by supplementing the flow diagram in FIG. 6*c* whenever no appreciable change dtl in load has been detected in step 615. A corresponding modification is illustrated in FIG. 9.

Figure 9:
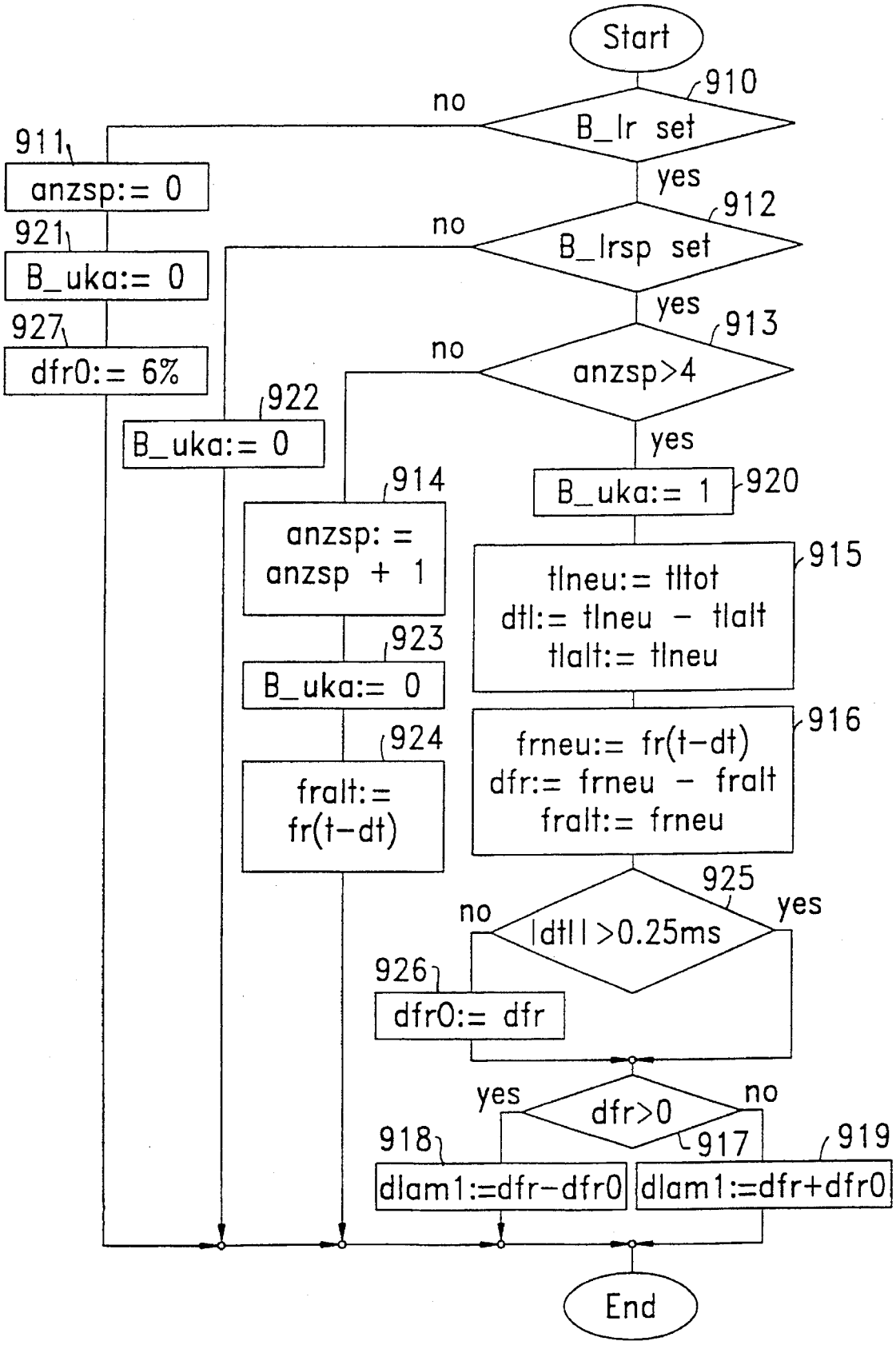
FIG. 9 is a flow-chart illustrating a variant of the method of FIG. 6*c* in which the aging of lambda probes and a change in the control range caused thereby are taken into account.

The steps 910–924 in the procedure of FIG. 9 correspond to the steps 610–624 in the procedure of FIG. 6*c*. After step 916, in which the control range dfr is calculated, it is then determined in step 925 whether a change in load has occurred. If this is not the case, the control range dfr is saved, in step 926, as the control range dfr0 in the fault free case. In steps 918 and 919, in contrast with steps 618 and 619 in FIG. 6*c*, the instantaneous control range dfr is then corrected by the value dfr0 and not by a fixed amount of 6%. If it is determined in step 910 that the lambda control is not operative, the counter anzsp for probe jumps is then cleared in step 911 and the flag B_uka is reset in step 921. In addition, the control range dfr0 is set in step 927 to the new state (6%).

A fault in the air/fuel mixture can take place not only as a result of a badly adapted wall film compensation but also as a result of supplying air/fuel mixture from the activated carbon filter of the fuel tank vent. Since the opening of the fuel venting valve 123 is frequently controlled in a load dependent manner, this means that the supply of air/fuel mixture via the fuel venting valve changes greatly in the case of an acceleration or deceleration. Thus, it is no longer possible to conclude from a mixture deviation and a simultaneously detected change in load that there is a modified wall film behavior since the mixture deviation can also be caused by the changed flow through the fuel venting valve. Therefore, in systems with such a fuel tank vent the adaptation of the wall film compensation must be prohibited if the pulse duty factor with which the tank venting valve 123 is actuated exceeds a specific limit value. Such a provision can be implemented simply by also testing in step 610 of FIG. 6*c*, the actuation of the fuel tank venting valve. Branching then takes place to step 611 if B_lr is set and if the pulse duty factor is greater than the prescribed limit value.

What is claimed is:

1. A method for metering fuel in an internal combustion engine, comprising the steps of:

providing a basic fuel injection quantity signal on the basis of an operating state of the internal combustion engine;

providing a mixture correction signal for correcting a deviation of an air/fuel ratio from a desired value;

determining an adaptive correction factor by comparing the mixture correction signal with a reference;

generating a transition compensation signal as a function of the adaptive correction factor; and generating a fuel injection quantity signal by logically combining the transition compensation signal and the basic fuel injection quantity signal.

2. The method according to claim 1, wherein the step of comparing the mixture correction signal with the reference is carried out by means of a variable which is dependent on minimum and maximum values of an oscillation of the mixture correction signal.

3. The method according to claim 1, wherein the step of comparing the mixture correction signal with the reference is carried out by means of a variable which is dependent on the time periods of two successive half-cycles of the mixture correction signal.

4. The method according to claim 1, wherein the step of determining the adaptive correction factor includes determining an estimated value for the air/fuel ratio.

5. The method according to claim 1, wherein the reference is determined from a variation over time of the mixture correction signal whenever the internal combustion engine is in a steady operating state.

6. A method for metering fuel in an internal combustion engine, comprising the steps of:

providing a basic fuel injection quantity signal on the basis of an operating state of the internal combustion engine;

detecting an output signal of an exhaust gas sensor;

determining an adaptive correction factor by comparing the output signal of the exhaust gas sensor with a reference;

generating a transition compensation signal as a function of the adaptive correction factor; and generating a fuel injection quantity signal by logically combining the transition compensation signal and the basic fuel injection quantity signal.

7. The method according to claim 6, wherein the step of comparing the output signal of the exhaust gas sensor with the reference is carried out by means of a variable which is dependent on minimum and maximum values of an oscillation of the sensor output signal.

8. The method according to claim 7, wherein the reference is determined from a variation over time of the output signal whenever the internal combustion engine is in a steady operating state.

9. The method according to claim 6, wherein a new value for the adaptive correction factor is determined whenever it is detected that the internal combustion engine is in a nonsteady operating state.

10. The method according to claim 9, wherein the internal combustion engine is detected to be in a nonsteady operating state when a magnitude of a change in load exceeds a preselected threshold value.

11. A method for metering fuel in an internal combustion engine, comprising the steps of:

providing a basic fuel injection quantity signal on the basis of an operating state of the internal combustion engine;

detecting an output signal of an exhaust gas sensor;

providing a mixture correction signal for correcting a deviation of an air/fuel ratio from a desired value;

determining an adaptive brief portion correction factor by comparing the output signal of the exhaust gas sensor with a first reference;

determining an adaptive long portion correction factor by comparing the mixture correction signal with a second reference;

generating a transition compensation signal as a function of at least a first and second component, the first component being formed by combining a brief injection time portion with the adaptive brief portion correction factor and the second component being formed by combining a long injection time portion with the adaptive long portion correction factor; and generating a fuel injection quantity signal by logically combining the transition compensation signal and the basic fuel injection quantity signal.

12. The method according to claim 11, wherein different values for the adaptive correction factors can be determined for different engine temperature ranges.

* * * * *